US005967129A

United States Patent [19]

Yamashita et al.

[11] Patent Number: 5,967,129

[45] Date of Patent: Oct. 19, 1999

[54] AIR-FUEL RATIO CONTROL FOR INTERNAL COMBUSTION ENGINE ENABLING FEEDBACK BEFORE SENSOR ACTIVATION

[75] Inventors: Yukihiro Yamashita; Hisashi Iida, both of Kariya, Japan

[73] Assignee: Denso Corporation, Kariya, Japan

[21] Appl. No.: 09/055,320

[22] Filed: Apr. 6, 1998

[30] Foreign Application Priority Data

Apr. 14, 1997 [JP] Japan ..... 9-095730

[51] Int. Cl.[6] ..... F02M 25/00

[52] U.S. Cl. ..... 123/674; 123/688

[58] Field of Search ..... 123/674, 688

[56] References Cited

U.S. PATENT DOCUMENTS

| | | | |
|---|---|---|---|
| 4,785,780 | 11/1988 | Kawai . | |
| 5,575,266 | 11/1996 | Iida | 123/688 |
| 5,671,721 | 9/1997 | Aoki | 123/688 |
| 5,758,310 | 5/1998 | Kato | 123/688 |
| 5,765,541 | 6/1998 | Farmer et al. | 123/674 |
| 5,775,311 | 7/1998 | Kato et al. | 123/688 |

FOREIGN PATENT DOCUMENTS

| | | |
|---|---|---|
| 53-57323 | 5/1978 | Japan . |
| 57-143143 | 9/1982 | Japan . |
| 3-294637 | 12/1991 | Japan . |
| 7-127502 | 5/1995 | Japan . |
| 8-201334 | 8/1996 | Japan . |

*Primary Examiner*—John Kwon

*Attorney, Agent, or Firm*—Nixon & Vanderhye P.C.

[57] ABSTRACT

An air-fuel ratio control using an A/F sensor which outputs a current representing an air-fuel ratio in response to a voltage applied thereto. If the A/F sensor is still in a state prior to activation and the actual air-fuel ratio is different from an air-fuel ratio represented by a current of the sensor in the state prior to activation when the engine is started, that is, if the air-fuel ratio is put on the rich side by an increased amount of fuel injected at a start of an internal combustion engine at a low temperature or other causes, for example a CPU employed in an ECU, determines whether the difference between the λ-conversion value of the current of the A/F sensor and a target air-fuel ratio is equal to or greater than a predetermined value. If the determination is YES, a feedback control of the air-fuel ratio is started. Then, the CPU carries out the feedback control of the air-fuel ratio based on a deviation of the current of the A/F sensor from a current value representing the target air-fuel ratio.

20 Claims, 12 Drawing Sheets

AIR-FUEL RATIO CONTROL FOR INTERNAL COMBUSTION ENGINE ENABLING FEEDBACK BEFORE SENSOR ACTIVATION

CROSS REFERENCE TO RELATED APPLICATION

This application relates to and incorporates herein by reference Japanese patent application No. 9-95730 file on Apr. 14, 1997.

BACKGROUND OF THE INVENTION

1. Field of the Invention

The present invention relates to an air-fuel ratio control for internal combustion engine which feedback controls an air-fuel ratio of air-fuel mixture to a target air-fuel ratio based on a deviation of a current output of an air-fuel ratio sensor.

2. Description of Related Art

Conventionally, there has been implemented an air-fuel ratio feedback control apparatus for carrying out feedback control of the air-fuel ratio based on the output of an oxygen sensor ($O_2$ sensor) which generates a stepwise voltage signal in dependence on whether the air-fuel ratio is on the rich side or the lean side of the stoichiometric air-fuel ratio. In an air-fuel ratio control apparatus employing an oxygen sensor, feedback control of the air-fuel ratio is started when the oxygen sensor starts outputting a voltage signal. With the exhaust gas regulation enforced in recent years, on the other hand, another air-fuel ratio sensor such as a linear A/F sensor of a limit current type which is capable of outputting a current signal linearly is used to feedback control of the air-fuel ratio in place of the oxygen sensor (JP-A 8-201334). This linear air-fuel ratio sensor outputs a current representing the air-fuel ratio in response to a voltage applied to the sensor. In the case of the linear air-fuel ratio sensor, a feedback gain of the feedback control can be set at a higher level.

Such a linear air-fuel ratio sensor starts outputting the current even before reaching a temperature of activation. Before attaining the temperature of activation, however, the output current representing the actual air-fuel ratio becomes smaller than a current which is to be output after the temperature of activation is reached or the sensor response characteristics becomes slow. If the feedback control of the air-fuel ratio is started while the air-fuel ratio sensor is still before the activation, the feedback control will be carried out with the correlation of the current output of the sensor to the actual air-fuel ratio remaining shifted. This will degrade drivability. In addition, when the feedback control is started later due the fact that the air-fuel ratio sensor is in a cold state (in an inactive state), the air-fuel ratio control to the highest purification range of a catalyst is delayed. It is thus desirable to start the feedback control at an earlier stage.

SUMMARY OF THE INVENTION

It is thus an object of the present invention to provide an air-fuel ratio control which is capable of expediting a feedback control of air-fuel ratio with an air-fuel ratio sensor still not activated enough.

According to the present invention, when an air-fuel ratio sensor is not in an activated state and an actual air-fuel ratio is different from an air-fuel ratio represented by a current output of the sensor in the state prior to activation, the air-fuel ratio control apparatus determines whether or not the current output of the sensor has changed from a value in an initial state by at least a predetermined variance. If the result of the determination indicates that the current output of the sensor has changed from a value in an initial state by at least the predetermined variance, the feedback control of the air-fuel ratio is started.

The air-fuel ratio sensor in a cold state prior to activation does not output a current, that is, outputs a current of 0 A, even if a voltage is applied to the sensor. The feedback control of the air-fuel ratio can not be implemented in such a state. In this case, if an increased amount of fuel supplied during the cold start of the internal combustion engine results in an air-fuel ratio on the rich side at which the actual air-fuel ratio is different from an air-fuel ratio represented by the current output of the air-fuel ratio sensor in the state prior to the activation of the sensor, the current output of the sensor starts to change, accompanying the activation of the sensor. As a result, by taking the change in sensor output current as a parameter to start the feedback control of the air-fuel ratio, the control can be started at a proper time without the need to wait for the air-fuel ratio sensor to be activated completely. That is, the feedback control of the air-fuel ratio can be expedited at the time the internal combustion engine is started with the air-fuel ratio sensor still in a cold state, allowing the drivability to be improved.

BRIEF DESCRIPTION OF THE DRAWINGS

Other objects, features and advantages of the present invention will become more apparent from the following detailed description when read with reference to the accompanying drawings. In the drawings.

DETAILED DESCRIPTION OF THE PREFERRED EMBODIMENT

Figure 1:
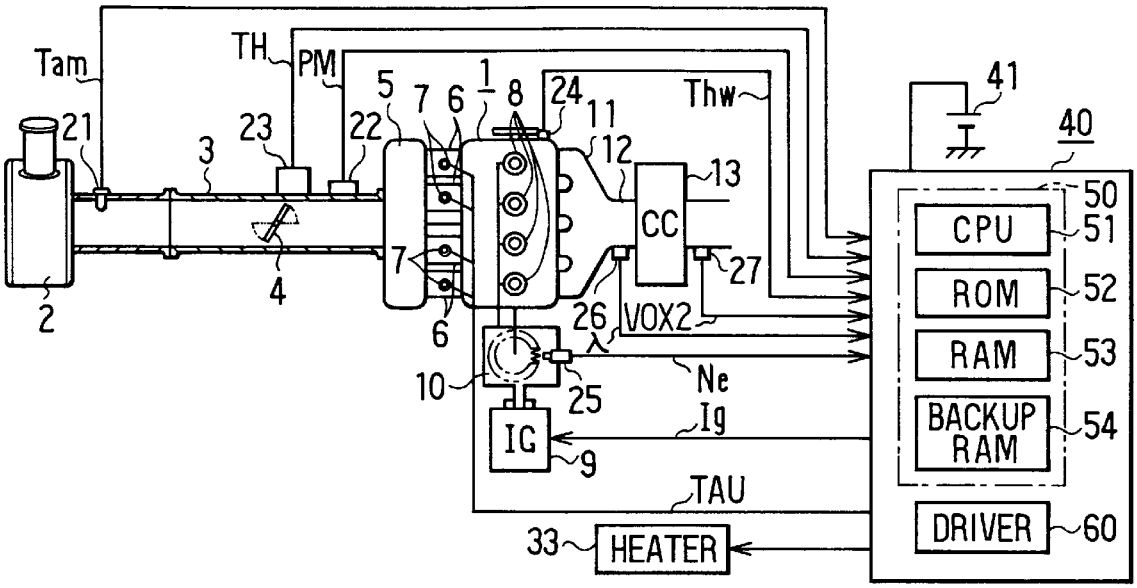
FIG. 1 is a schematic diagram showing an internal combustion engine employing an air-fuel ratio control apparatus according to an embodiment of the present invention.

In FIG. 1, an internal combustion engine 1 is a 4-cylinder, 4-cycle spark ignition type. In this engine 1, intake air flowing from an upstream side passes through an air cleaner 2, an intake pipe 3, a throttle valve 4, a surge tank 5 and intake manifolds 6 and is mixed with fuel injected from fuel injecting valves 7 of each cylinder of the engine 1 in the intake manifolds 6. Then, mixed gas comprising the air and the fuel is supplied to each cylinder.

A high voltage supplied by an ignition circuit (IG) 9 is distributed and applied to an ignition plug 8 provided on each cylinder of the engine 1 through a distributor 10 so that the ignition plug 8 ignites the mixed gas in each cylinder. After combustion, exhaust gas is exhausted from the cylinders to the atmosphere by way of an exhaust manifold 11 and an exhaust pipe 12. Before the gas is exhausted to the atmosphere, noxious components such as CO, HC and NOx are removed from the exhaust gas by a three-way catalyst converter (CC) 13 provided on the exhaust pipe 12.

On the intake pipe 3, an intake temperature sensor 21 for sensing an intake temperature Tam, that is, the temperature of the intake air is provided. Also installed on the intake pipe 3 is an intake pressure sensor 22 for sensing an intake pressure PM, that is, the pressure inside the intake pipe 3 on the downstream side of the throttle valve 4. In addition, the throttle valve 4 is provided with a throttle sensor 23 for sensing a throttle opening angle TH, that is, the opening angle of the valve 4. The throttle sensor 23 outputs an analog signal representing the throttle opening angle TH. The throttle sensor 23 includes an idle switch therein for outputting a detection signal indicating that the throttle valve 4 is closed fully.

A coolant water temperature sensor 24 for sensing a cooling water temperature Thw, that is, the temperature of cooling water circulating throughout the engine 1 is further provided on the cylinder block of the engine 1. The distributor 10 is provided with a rotational speed sensor 25 for detecting an engine rotational speed Ne, that is, the rotational speed of the engine 1. The rotational speed sensor outputs 24 pulses for each two rotations of the engine 1, that is, 24 pulses for each 720 degrees CA at equal angular intervals.

In addition, an A/F sensor 26 implemented by a linear air-fuel ratio sensor of a limit current type, is installed on the upstream side of the three-way catalyst converter 13 provided on the exhaust pipe 12. The A/F sensor 26 outputs an air-fuel ratio signal λ which is linear and proportional to the concentration of oxygen or carbon dioxide included in gas exhausted from the engine 1 over a wide range. On the other hand, a downstream $O_2$ sensor 27 is provided on the downstream side of the catalyst 13. The downstream $O_2$ sensor 27 outputs a voltage signal VOX2 indicating whether the air-fuel ratio is on the rich or lean side of the stoichiometric air-fuel ratio which corresponds to a λ value of 1 (air-fuel ratio≈14.7).

The linear A/F sensor 26 is known well and has a solid electrolyte layer serving as an oxygen concentration detecting element is provided to have a cross section resembling a cup. An exhaust gas side electrode layer and an atmosphere side electrode layer are firmly attached respectively to the outer surface and the inner surface of the cup resembling shape of the solid electrolyte layer. On the outer surface of the exhaust gas side electrode layer, a diffused resistance layer is further provided. A heater 33 is accommodated in the atmosphere side electrode layer, the cross section of which also resembles a cup. Thermal energy generated by the heater 33 heats the atmosphere side electrode layer, the solid electrolyte layer and the exhaust gas side electrode layer which constitute the main body of the A/F sensor 26. The heater 33 has a heat generating power large enough for putting the main body of the A/F sensor 26 in an active state. While the A/F sensor 26 is capable of sensing the concentration of oxygen in accordance with a linear characteristic thereof, it is necessary to raise the temperature of the A/F sensor 26 to a value equal to or higher than 600° C. in order to put the sensor 26 in an active state. Its active temperature range is narrow. As a result, it is impossible to control the operation of the A/F sensor 26 by resorting only to heat dissipated by gas exhausted by the engine 1. An ECU 40 to be described later is used for controlling an operation of the heater 33 to heat the A/F sensor 26 and keep the sensor 26 at a predetermined active temperature as well as for controlling fuel injection and ignition timing.

Figure 2:
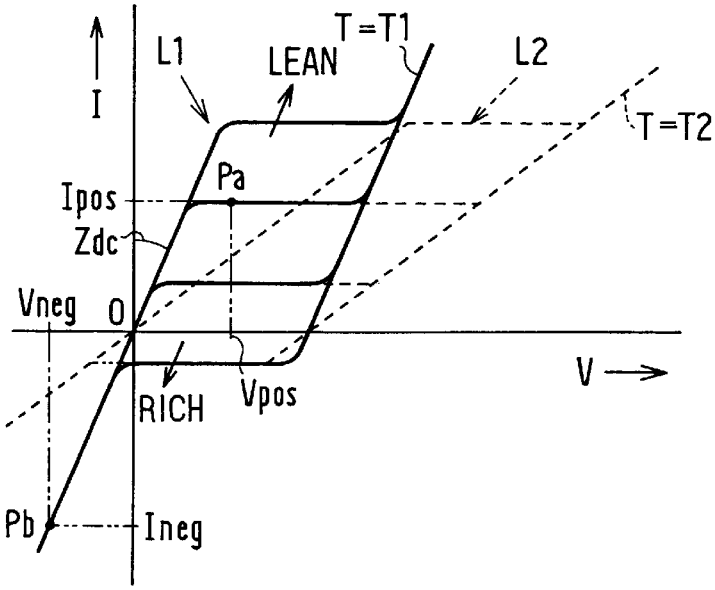
FIG. 2 is a voltage-current characteristic diagram showing output characteristics of an A/F sensor used in the embodiment.

As shown by the voltage-current characteristics in FIG. 2, when the A/F sensor 26 is put in an active state at a temperature T equal to T1, the sensor outputs a stable current in accordance with a characteristic curve L1 shown by a solid line. A straight line segment of the characteristic curve L1 parallel to a voltage axis V represents the limit current of the A/F sensor 26. The magnitude of the limit current, varies in accordance with whether the air-fuel ratio is in the lean or rich side. To be more specific, the greater the air-fuel ratio is on the lean side, the greater the limit current is. That is, the greater the air-fuel ratio is on the rich side, the smaller the limit current is.

A zone in the voltage-current characteristic in which the voltage is lower than the straight line segment parallel to the voltage axis V is an element resistance-dominating zone. The gradient of the characteristic curve L1 in the resistance-dominating zone is determined by the internal resistance of the solid electrolyte layer of the A/F sensor 26 (element impedance Zdc). The element impedance Zdc varies accompanying a change in temperature. To be more specific, as the temperature of the device decreases, the value of Zdc increases, reducing the gradient of the characteristic curve L1. That is, when the temperature T of the device decreases from T1 to a lower temperature T2, the voltage-current characteristic is determined by a characteristic curve L2 shown by a dashed line in the figure. Much like the characteristic curve L1, a straight line segment of the characteristic curve L2 parallel to a voltage axis V represents the limit current of the A/F sensor 26 at the temperature T2. As shown in the figure, the limit current at T2 almost coincides with the limit current determined by the characteristic curve L1 for the temperature T1.

With the air-fuel ratio having a value on the lean side and the A/F sensor 26 set at a temperature T1 represented by the characteristic L1, applying a positive voltage Vpos to the A/F sensor 26 will cause the sensor 26 to generate a current Ipos as indicated by a point Pa in FIG. 2. If a negative voltage Vneg is applied to the A/F sensor 26, the sensor 26 will generate a negative current Ineg which is proportional to the temperature only independently of the concentration of oxygen as indicated by a point Pb in FIG. 2.

The ECU 40 for controlling the operation of the engine 1 shown in FIG. 1 comprises two principal components. One is a microcomputer 50 for mainly controlling injection of fuel to the cylinders and spark ignition of mixed gases in the cylinders. The other is a sensor driver circuit 60 for controlling an operation to drive the A/F sensor 26. The microcomputer 50 comprises logic processing circuits including main components such as a CPU (Central Processing unit) 51, a ROM (Read Only Memory) unit 52, a RAM (Random Access Memory) unit 53 and a backup RAM unit 54. The microcomputer 50 receives detection signals from a variety of sensors such as the intake air temperature Tam, the intake air pressure PM, the throttle opening angle TH, the cooling water temperature Thw, the engine rotational speed Ne, the air-fuel ratio λ and the oxygen concentration VOX2. These input values are used for calculating and setting control signals such as those representing a fuel injection amount TAU and an ignition time Ig. The control signals are then output to components such as the fuel injecting valve 7 and the ignition circuit 9. The ECU 40 is connected to a battery 41 which serves as a main power supply.

Figure 3:
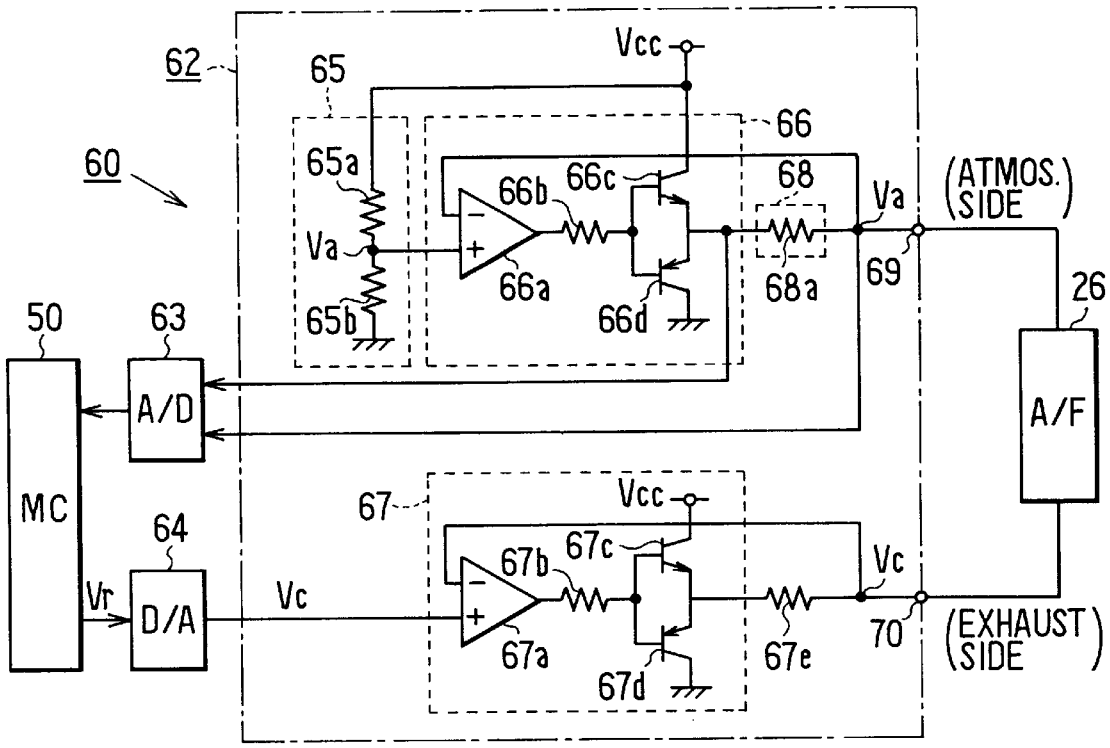
FIG. 3 is a circuit diagram showing an electric circuit construction of a sensor driver circuit used in the embodiment.

As shown in FIG. 3, the sensor driver circuit 60 comprises a bias control circuit 62 controlled by the microcomputer (MC) 50 in addition to an A/D converter 63 and a D/A converter 64 which both serve as an interface between the microcomputer 50 and the bias control circuit 62. The microcomputer 50 (the CPU 51 employed in the microcomputer 50), outputs a bias command signal Vr for detecting an air-fuel ratio in a semi-active state and in an active state of the A/F sensor 26 to the bias control circuit 62 by way of the D/A converter 64. The D/A converter 64 converts the bias command signal Vr into an analog voltage signal Vc and outputs the signal Vc to the bias control circuit 62. The bias control circuit 62 comprises main components including a reference voltage circuit 65, a first voltage supplying circuit 66, a second voltage supplying circuit 67 and a current detecting circuit 68.

The reference voltage circuit 65 comprises resistors 65*a* and 65*b* for generating a fixed reference voltage Va. The first voltage supplying circuit 66 is implemented by a voltage follower circuit for supplying a voltage equal in level to the reference voltage Va to an output terminal 69 connected to one side of the A/F sensor 26, that is, a terminal connected to the atmosphere side electrode layer. Specifically, the first voltage supplying circuit 66 comprises an operational amplifier 66*a*, a resistor 66*b*, an NPN transistor 66*c*, a PNP transistor 66*d* and a current detecting resistor 68*a* of the current detecting circuit 68. The non-inverting input terminal of the operational amplifier 66*a* is connected to the junction between the resistors 65*a* and 65*b* whereas the inverting input terminal of the operational amplifier 66*a* is connected the output terminal 69. The output terminal of the operational amplifier 66*a* is connected to one end of the resistor 66*b*. The other end of the resistor 66*b* is connected to the bases of the NPN and PNP transistors 66*c* and 66*d*. The collector of the NPN transistor 66*c* is connected to a constant voltage power supply Vcc and the emitter of the NPN transistor 66*c* is connected to the emitter of the PNP transistor 66*d*. The collector of the PNP transistor 66*d* is connected to the ground. The emitters of the NPN and PNP transistors 66*c* and 66*d* are connected to one end of the current detecting resistor 68*a* and the other end of the current detecting resistor 68*a* is connected to the output terminal 69.

Much like the first voltage supplying circuit 66, the second voltage supplying circuit 67 is implemented by a voltage follower circuit for supplying a voltage equal in level to the voltage signal Vc output by the D/A converter 64 to an output terminal 70 connected to the other side of the A/F sensor 26, that is, a terminal connected to the exhaust gas side electrode layer. Specifically, the second voltage supplying circuit 67 comprises an operational amplifier 67*a*, a resistor 67*b*, an NPN transistor 67*c*, a PNP transistor 67*d* and a resistor 67*e*. The non-inverting input terminal of the operational amplifier 67*a* is connected to the output terminal of the D/A converter 64 whereas the inverting input terminal of the operational amplifier 67*a* is connected to the output terminal 70. The output terminal of the operational amplifier 67*a* is connected to one end of the resistor 67*b*. The other end of the resistor 67*b* is connected to the bases of the NPN and PNP transistors 67*c* and 67*d*. The collector of the NPN transistor 67*c* is connected to the constant voltage power supply Vcc and the emitter of the NPN transistor 67*c* is connected to the emitter of the PNP transistor 67*d*. The collector of the PNP transistor 67*d* is connected to the ground. The emitters of the NPN and PNP transistors 67*c* and 67*d* are connected to one end of the resistor 67*e* and the other end of the resistor 67*e* is connected to the output terminal 70.

In this circuit configuration, the fixed reference voltage Va is supplied to the output terminal 69 connected to the atmosphere side electrode layer of the A/F sensor 26 all the time whereas the variable voltage Vc output by the D/A converter 64 is supplied to the output terminal 70 connected to the exhaust gas side electrode layer of the sensor 26. If the voltage Vc is lower than the reference voltage Va (Vc<Va), a positive bias is applied to the A/F sensor 26. If the voltage Vc is higher than the reference voltage Va (Vc>Va), on the other hand, a negative bias is applied to the A/F sensor 26. The limit current (output current) that flows through the A/F sensor 26 as a result of applying the voltage to the sensor 26 is detected as a difference in electric potential between the two ends of the current detecting resistor 68*a* which is supplied to the microprocessor 50 by way of the A/D converter 63.

The air-fuel ratio control apparatus, particularly the microcomputer 50 (CPU 51), is programmed to execute the following control process.

Figure 4:
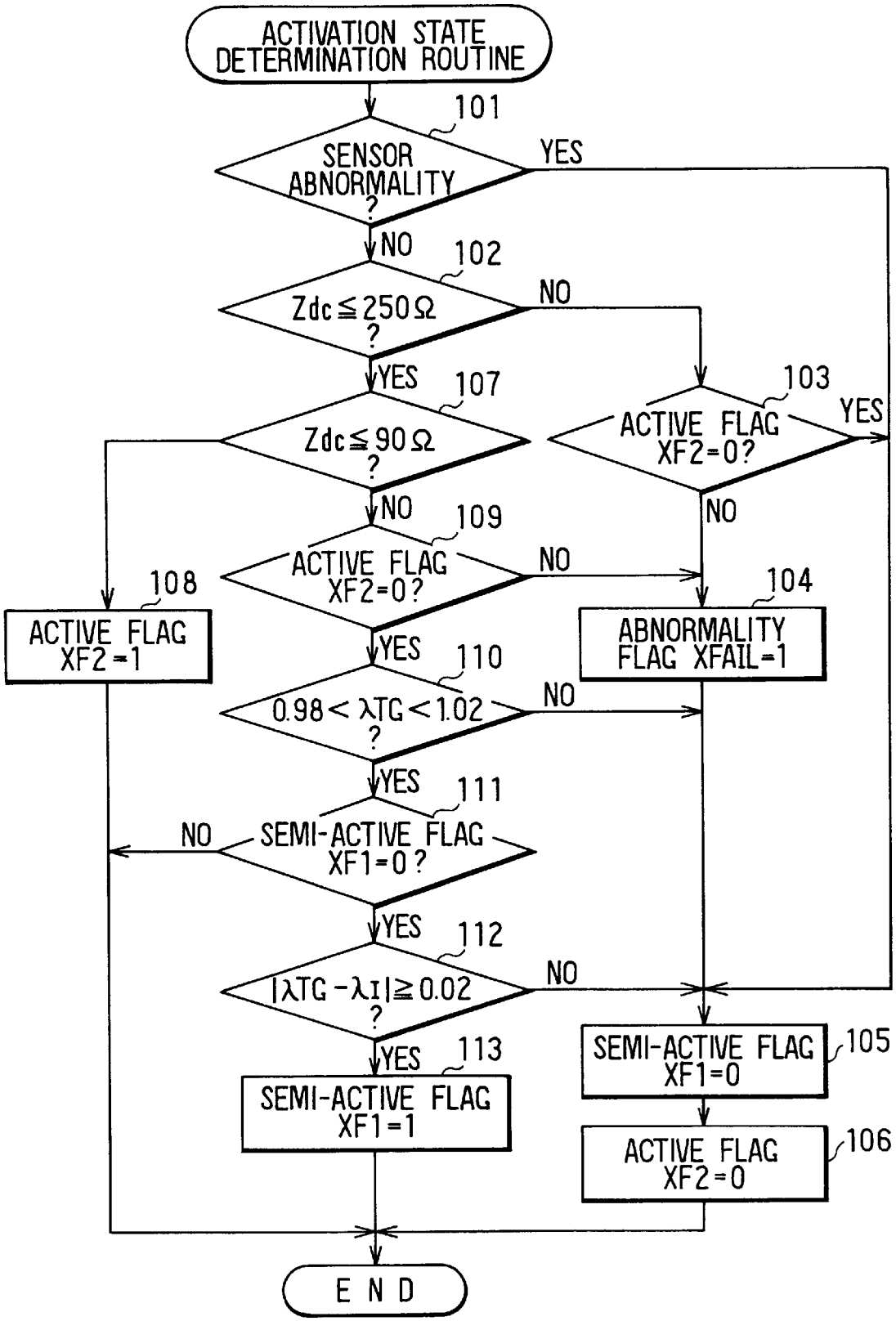
FIG. 4 is a flowchart showing a routine for determining the state of activation of the A/F sensor.

The CPU 51 executes a routine of FIG. 4 for determining the state of activation of the A/F sensor 26 at predetermined intervals as triggered by a timer interrupt. In the present embodiment, the period of the intervals is set at 128 msec. In this routine, a semi-active state flag XF1 and an active state flag XF2 are used as flags for indicating the activation state of the A/F sensor 26. Specifically, a value of 0 set in the semi-active state flag XF1 indicates that the A/F sensor 26 is in inactive state while a value of 1 set in the flag XF1 indicates that the A/F sensor 26 is in a semi-active state. On the other hand, a value of 0 set in the active state flag XF2 indicates that the A/F sensor 26 is in inactive or semi-active state while a value of 1 set in the flag XF2 indicates that the A/F sensor 26 is in an active state. The semi-active state flag XF1 and the active state flag XF2 are initialized to '0' when an IG (ignition) key is turned on.

As shown in FIG. 4, the activation state determination routine begins with step 101 at which the CPU 51 determines whether or not an abnormality has occurred in the sensor system. The determination is made by determining whether or not a failure such as a broken wire or a shorted circuit has been detected or by checking a sensor fail code. An example of the sensor fail code is a sensor abnormality flag XFAIL to be described later. A value of 1 set in the sensor abnormality flag XFAIL indicates that a sensor abnormality has been detected. If the determination indicates that there is no abnormality detected in the sensor system, the routine executed by the CPU 51 proceeds to step 102.

Figure 8:
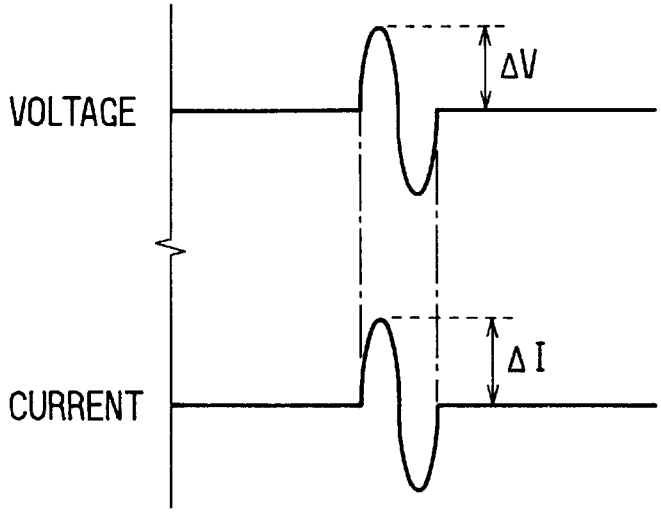
FIG. 8 is a diagram showing waveforms of a voltage applied to the A/F sensor and an output current generated to detect an element impedance of the sensor.

At step 102, the CPU 51 determines whether or not the element impedance Zdc is equal to or smaller than a predetermined criterion value used for determining the activation state of the A/F sensor 26. In the present embodiment, the criterion value is set at about 250 Ω. The element impedance Zdc is found as follows. The voltage applied to the A/F sensor 26 is temporarily changed in the positive and negative directions as shown in FIG. 8. The positive or negative change in voltage ΔV results in a change in current ΔI. The element impedance Zdc is calculated as a ratio of the change in voltage ΔV to the change in current ΔI (Zdc=ΔV/ΔI). However, this method of finding the element impedance Zdc is no more than an example. The element impedance Zdc can be found by using the changes in voltage and current in both the directions or detecting a negative output current Ineg which flows as a result of by applying a negative voltage Vneg (Zdc=Vneg/Ineg).

The NO determination made at step 102, that is, a element impedance Zdc greater than 250 Ω (Zdc>250 Ω) indicates that the temperature of the A/F sensor 26 is still low. In this case, the routine proceeds to step 103 at which the CPU 51 determines whether or not the active state flag XF2 is '0'. A value of 0 set in the active state flag XF2 indicates that the device temperature, that is, the temperature of the A/F sensor 26, is low as is observed for example at the time the engine 1 is started at a low temperature. In this case, the routine proceeds to step 105 at which the CPU 51 sets the semi-active state flag XF1 at '0' and then to step 106 at which the CPU 51 sets the active state flag XF2 at '0' prior to termination of this routine.

If the determination made at step 103 is NO, that is, the active state flag XF2 is '1' indicating an active state of the A/F sensor 26 and the element impedance Zdc is greater than 250 Ω (Zdc>250 Ω), the element impedance Zdc is considered to have increased after the A/F sensor 26 once entered an active state. The increase in element impedance Zdc is attributed to a decrease in device temperature which is caused by some abnormalities. In this case, the routine proceeds to step 104 at which the CPU 51 sets the sensor abnormality flag XFAIL at '1'. Then, the routine proceeds to step 105 at which the CPU 51 sets the semi-active state flag XF1 at '0' and then to step 106 at which the CPU 51 sets the active state flag XF2 at '0'. That is, the CPU 51 determines that a sensor failure has occurred.

If the determination made at step 102 is YES, that is, if the element impedance Zdc is equal to or smaller than 250 Ω (Zdc≧250 Ω), on the other hand, the routine proceeds to step 107 at which the CPU 51 determines whether or not the element impedance Zdc is equal to or smaller than another predetermined criterion value used for determining the activation state of the A/F sensor 26. In the present embodiment, the other criterion value is set at about 90 Ω. If the element impedance Zdc is equal to or smaller than 90 Ω, (Zdc≧90 Ω), the routine proceeds to step 108 at which the CPU 51 sets the active state flag XF2 at '1' prior to termination of this routine.

If the element impedance Zdc is greater than 90 Ω (Zdc>90 Ω), on the other hand, the routine proceeds to step 109 at which the CPU 51 determines whether or not the active state flag XF2 is '0'. In a normal condition, a element impedance Zdc greater than 90 Ω indicates that the A/F sensor 26 is in a state prior to complete activation. In this case, the determination made at step 109 will result in YES. If, by any chance, the determination made at step 109 is NO, that is, the active state flag XF2 is '1' but the element impedance Zdc is greater than 90 Ω (Zdc>90 Ω) as indicated by the NO determination made earlier at step 107, on the other hand, the element impedance Zdc is considered to have increased after the A/F sensor 26 once entered the active state. The increase in element impedance Zdc is attributed to a decrease in device temperature which is caused by some abnormalities. In this case, the routine proceeds to step 104 at which the CPU 51 sets the sensor abnormality flag XFAIL at '1'. Then, the routine proceeds to step 105 at which the CPU 51 sets the semi-active state flag XF1 at '0' and then to step 106 at which the CPU 51 sets the active state flag XF2 at '0' prior to termination of this routine.

In a normal condition, a element impedance Zdc having a value in the range 90 to 250 Ω as indicated by YES determination made at step 102 and NO determination made at step 107 indicates the semi-active state of the A/F sensor 26. In this case, the determination made at step 109 is YES and the routine proceeds to step 110 at which the CPU 51 determines whether or not a target air-fuel ratio λTG, that is, an excess air factor representing an air-fuel ratio taken as a target, is within a predetermined range. The determination processing is carried out by determining whether or not the target air-fuel ratio λTG almost agrees with an air-fuel ratio λ resulting from conversion of the output current generated by the A/F sensor 26 in an inactive state thereof. Since the target air-fuel ratio λTG is set at '1.0', in the present embodiment, the predetermined range is determined to be the range 0.98 to 1.02. The determination processing is reflected in a determination made at step 112 to be described later. The processing carried out at step 110 is a determination as to whether or not the output current almost agrees with the output of the sensor 26 representing the target air-fuel ratio prior to an active state of the A/F sensor 26.

Figure 11:
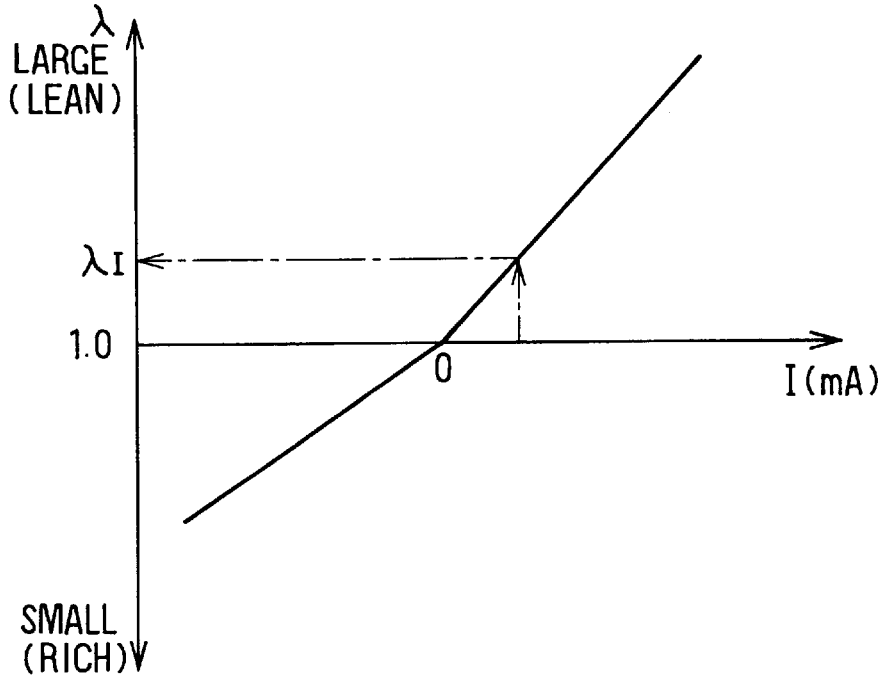
FIG. 11 is a diagram showing a map used for converting an output current into an air-fuel ratio λ.

If the determination made at step 110 is NO, the routine proceeds to step 105 at which the CPU 51 sets the semi-active state flag XF1 at '0' and then to step 106 at which the CPU 51 sets the active state flag XF2 at '0' prior to termination of this routine. If the determination made at step 110 is YES, on the other hand, the routine proceeds to step 111 at which the CPU 51 determines whether or not the semi-active state flag XF1 is '0'. If XF1=1, the processing is ended. If XF1=0, on the other hand, the routine proceeds to step 112 at which the CPU 51 determines whether or not the absolute value of the difference between the target air-fuel ratio λTG and a λ-conversion value λI of an output current of the A/F sensor 26 is equal to or greater than 0.02 as follows:

$$|\lambda TG-\lambda I|\geqq 0.02$$

where the λ-conversion value of the output current is an air-fuel ratio obtained from conversion based on a map shown in FIG. 11.

If the determination made at step 112 is NO, the routine proceeds to step 105 at which the CPU 51 sets the semi-active state flag XF1 at '0' and then to step 106 at which the CPU 51 sets the active state flag XF2 at '0' prior to termination of this routine. That is, the CPU 51 determines that the output current of the A/F sensor 26 can not be used in the feedback control of the air-fuel ratio. If the determination made at step 112 is YES, on the other hand, the routine proceeds to step 113 at which the CPU 51 sets the semi-active state flag XF1 at '1' prior to termination of this routine. The processing carried out at step 112 is a determination as to whether or not the output current of the A/F sensor 26 can be used in the feedback control of the air-fuel ratio. The criterion value 0.02 with which the absolute value of the difference between the target air-fuel ratio λTG and a λ-conversion value of an output current of the A/F sensor 26 (|λTG−λI|) is set typically in accordance with a characteristic shown in FIG. 9.

Figure 9:
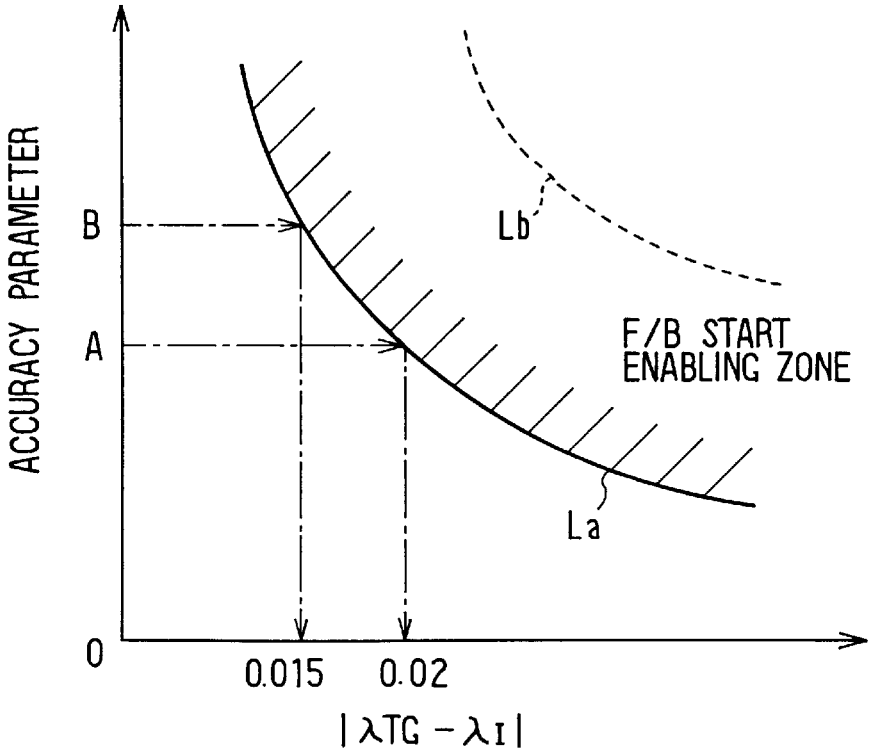
FIG. 9 is a diagram showing a map representing an allowable feedback control start zone for determining a criterion for the absolute value of a difference between a target air-fuel ratio and a λ-conversion value of the output current according to a value of an accuracy parameter.

The vertical axis of the characteristics shown in FIG. 9 represents a variety of accuracy parameters such as digit drops of the CPU 51, the LSB (Least Significant Bit) of a result of A/D conversion and a circuit tolerance. The greater the value of an accuracy parameter represented by the vertical axis, the more accurate the air-fuel ratio control apparatus and, hence, the higher the performance of the apparatus. The horizontal axis represents the criterion value for the absolute value of the difference between the target air-fuel ratio λTG and the λ-conversion value λI of the output current of the A/F sensor 26. A hatched area shown in the figure is referred to as an allowable feedback control start zone to be described later, that is, an area in which the feedback control of the air-fuel ratio can be started. A characteristic curve La serving as a limit of the area determines the minimum value of |λTG−λI| used as a criterion as to whether or not the feedback control of the air-fuel ratio can be started. That is, in the present embodiment, for an accuracy parameter having a value 'A', the value 0.02 is taken as a criterion value at step 112. It should be noted that a characteristic curve Lb shown in FIG. 9 serves as a limit of an allowable feedback control start zone upon completion of activation of the A/F sensor 26.

As a result, by setting the semi-active state flag XF1 in accordance with a criterion value determined by the characteristic curve La shown in FIG. 9, the feedback control of the air-fuel ratio can be started earlier without the need to wait for the A/F sensor 26 to be activated completely. The feedback control of the air-fuel ratio is carried out by execution of a fuel injection control routine of FIG. 5. If the value of the accuracy parameter can be increased to 'B' shown in FIG. 9 through the use of a more accurate air-fuel ratio control apparatus, for example, the value 0.015 can be used as a criterion value at step 112 of the routine, allowing the feedback control of the air-fuel ratio to be started even earlier.

Figure 5:
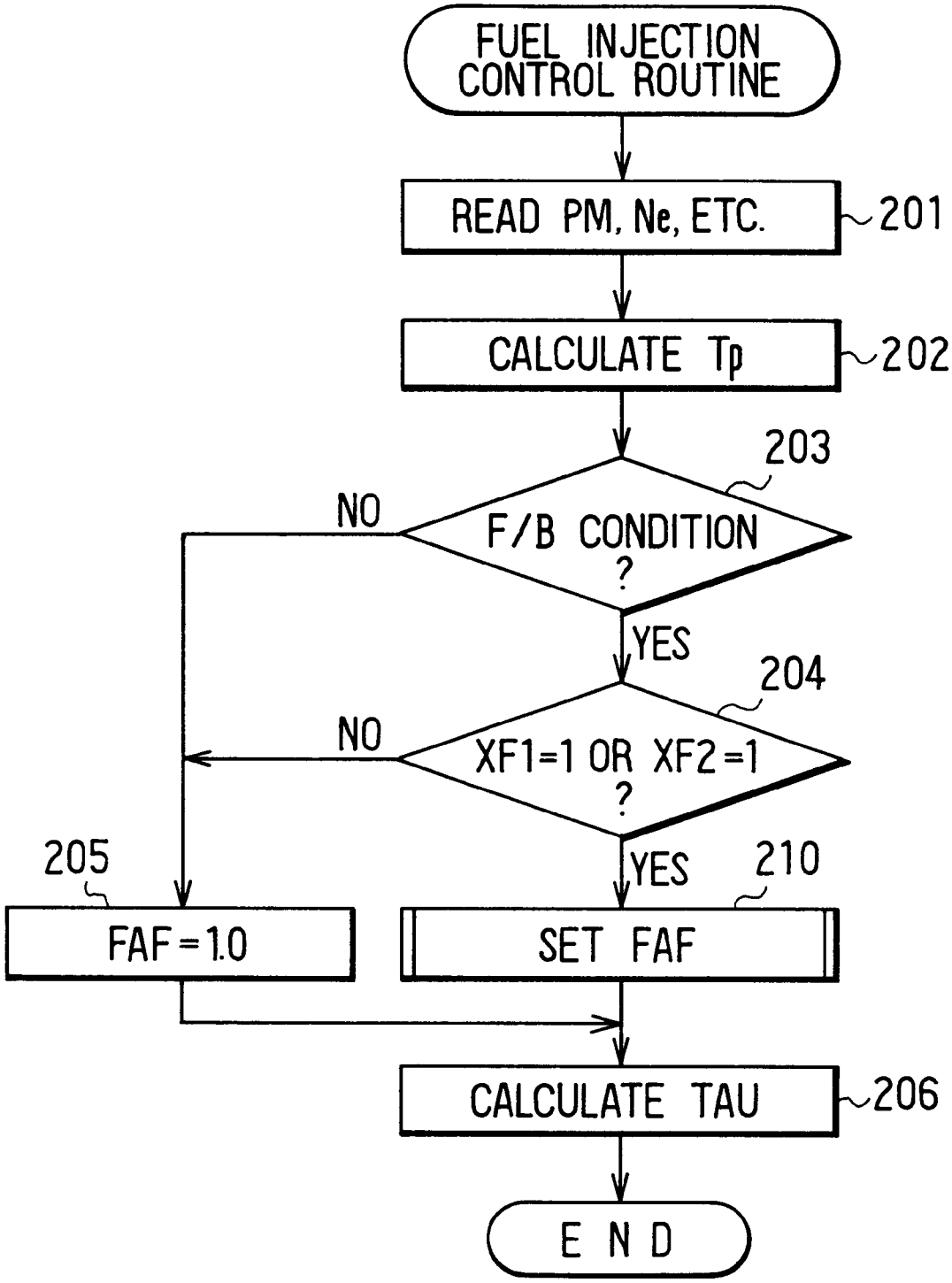
FIG. 5 is a flowchart showing a routine for controlling injection of fuel.

Next, the fuel injection control routine of the embodiment is explained by referring to a flowchart shown in FIG. 5. The routine is executed by the CPU 51 in synchronization with the injection of fuel to each cylinder. In the present embodiment, the routine is executed at crankshaft angular intervals of 180 degrees CA.

As shown in the flowchart of the figure, the routine starts with step 201 at which the CPU 51 reads detection signals from a variety of sensors such as the intake air pressure PM, the cooling water temperature Thw, and the engine rotational speed Ne which represent the operating state of the engine 1. The routine then proceeds to step 202 at which the CPU 51 calculates a basic injection amount Tp corresponding to the current engine rotational speed Ne and the current intake air pressure PM by using a basic injection amount map stored in advance in the ROM unit 52. Then, the routine proceeds to step 203 at which the CPU 51 determines whether or not the well-known required conditions of the feedback control of the air-fuel ratio are satisfied. The required feedback control conditions include a cooling water temperature Thw higher than a predetermined value and an engine state other than the high rotational speed state and the high load state.

Subsequently, the routine proceeds to step 204 at which the CPU 51 determines whether or not the semi-active state flag XF1 or the active state flag XF2 manipulated by the routine shown in FIG. 4 is set at '1'. A value of '1' set in the semi-active state flag XF1 or the active-state flag XF2 results in YES determination made at step 204.

If the determination made at step 203 or 204 is NO, the routine proceeds to step 205 at which the CPU 51 sets a feedback correction coefficient FAF at 1.0. The FAF with a value of 1.0 implies open loop control (no feedback control) of the air-fuel ratio. If the outcomes of the determination made at steps 203 and 204 are both YES, on the other hand, the routine proceeds to step 210 at which the CPU 51 sets the feedback correction coefficient FAF by execution of an FAF setting routine of FIGS. 6 and 7.

After the FAF has been set, the routine proceeds to step 206 at which the CPU 51 computes a final fuel injection amount TAU from the basic injection amount Tp, the feedback correction coefficient FAF and another correction coefficient FALL representing a variety of other correction coefficients such as the coolant temperature of the water and the load of the air conditioning by using the following Eq. (1):

$$TAU=Tp\times FAF\times FALL \tag{1}$$

After calculating the final fuel injection amount TAU, the CPU 51 ends the routine.

The FAF setting in step 210 implements feedback control of the air-fuel ratio based on the advanced control theory. In detail, in the implementation of the feedback control of the air-fuel ratio based on the advanced control theory, the feedback correction coefficient FAF for adjusting a result of detection output by the A/F sensor 26 to the target air-fuel ratio is computed by the following Eqs. (2) and (3). The procedure for setting the feedback correction coefficient FAF is disclosed in U.S. Pat. No. 4,785,780 (JP-A 1-1108539) incorporated herein by reference.

$$FAF=K1\times\lambda+K2\times FAF1+\cdots+Kn+1\times FAFn+ZI \tag{2}$$

$$ZI=ZI1+Ka\times(\lambda TG-\lambda I) \tag{3}$$

where, the symbols K1 to Kn+1 are feedback constants, the symbol ZI is an integration and the symbol Ka is a proportional constant. The subscript i is a variable representing the number of times the feedback control has been executed since the start of the sampling. In the following description, the symbols K1 to Kn+1 are used to represent feedback constants for control in an active state of the A/F sensor 26 while symbols K1' to Kn+1' are used to represent feedback constants for control in a semi-active state of the A/F sensor 26.

Figure 6:
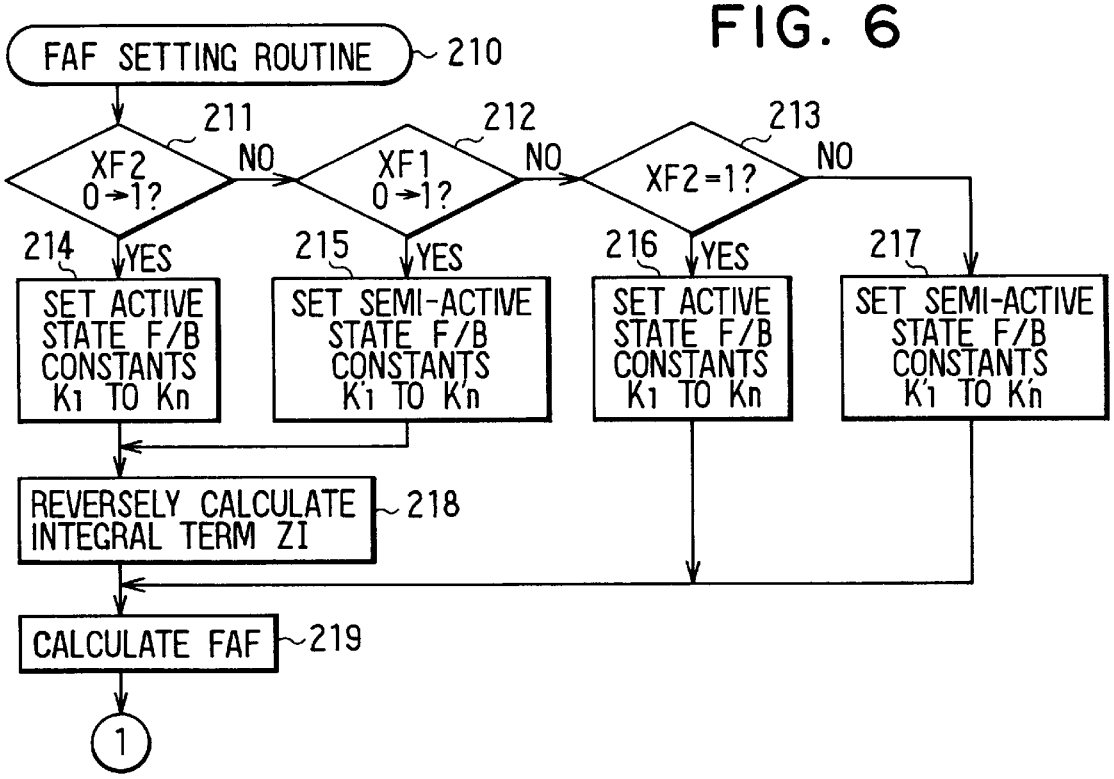
FIG. 6 is a flowchart showing a part of routine for setting an FAF value.

As shown in the flowchart of FIG. 6, the routine starts with steps 211, 212 and 213 at which determination is made by the CPU 51 in order to find out with what timing the semi-active state flag XF1 and the active state flag XF2 got to present states respectively. The routine shown in FIG. 6 is executed when the determination made at step 204 of the routine shown in FIG. 5 is YES indicating that either the flag XF1 or XF2 is set at '1'. More specifically, At step 211, the CPU 51 determines whether or not the active state flag XF2 is changed from '0' to '1' at step 212, the CPU 51 determines whether or not the semi-active state flag XF1 is changed from '0' to '1' at an immediately preceding execution of the routine shown in FIG. 4. At step 213, the CPU 51 determines whether or not the active state flag XF2 is set at '1'.

If the determination made at step 211 is YES, the routine proceeds to step 214 at which the CPU 51 sets the feedback constants K1 to Kn for the active state. The routine then proceeds to step 218. If the determination made at step 212 is YES, the routine proceeds to step 215 at which the CPU 51 sets the feedback constants K1' to Kn' for the semi-active state. The routine then proceeds to step 218. The feedback constants K1 to Kn and K1' to Kn' are set at values so that the semi-active state feedback constants K1' to Kn' provide a low degree of correction of the fuel injection amount in comparison with the active state feedback constants K1 to Kn. This is because it is necessary to take the responsiveness prior to completion of activation of the A/F sensor 26 into consideration. It should be noted, however, that values can also be selected so that the semi-active state feedback constants K1' to Kn' conversely provide a high degree of correction of the fuel injection amount in comparison with the active state feedback constants K1 to Kn depending on the design concept embraced.

After the feedback constants K1 to Kn for the active state or the feedback constants K1' to Kn' for the semi-active state are set at steps 214 or 215 respectively, the routine then proceeds to step 218 at which the CPU 51 reversely computes the integration ZI by using the following Eq. (4):

$$ZI=1.0-(K1\times\lambda I+K2\times FAF1+---+Kn+1\times FAFn) \quad (4)$$

If the determination made at step 213 is YES, that is, if XF2=1, the routine proceeds to step 216 at which the CPU 51 sets the feedback constants K1 to Kn for the active state. If the determination made at step 213 is NO, that is, if XF1=1, on the other hand, the routine proceeds to step 217 at which the CPU 51 sets the state feedback constants K1' to Kn' for the semi-active state.

Then, the flow of routine proceeds to step 219 at which the CPU 51 computes the value of the FAF by using Eq. (2). In the case of an operation to change the semi-active state flag XF1 or the active state flag XF2 from '0' to '1' at an immediately preceding execution of the routine shown in FIG. 4, that is, in the case of the YES determination made at step 211 or 212, the integration ZI is computed by using Eq. (4) as described above. In other cases, however, the integration ZI is computed by using Eq. (3). In either case, the computed integration ZI is used in the calculation of the FAF value by using Eq. (2).

Figure 7:
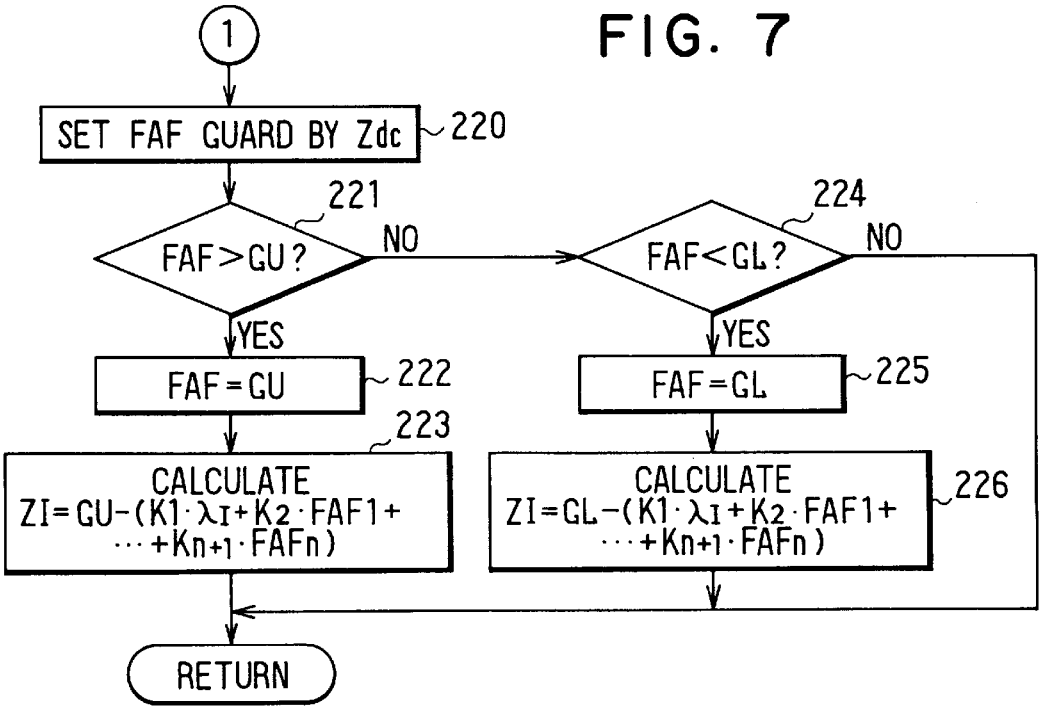
FIG. 7 is a flowchart showing another part of the routine for setting the FAF value shown in FIG. 6.
Figure 10:
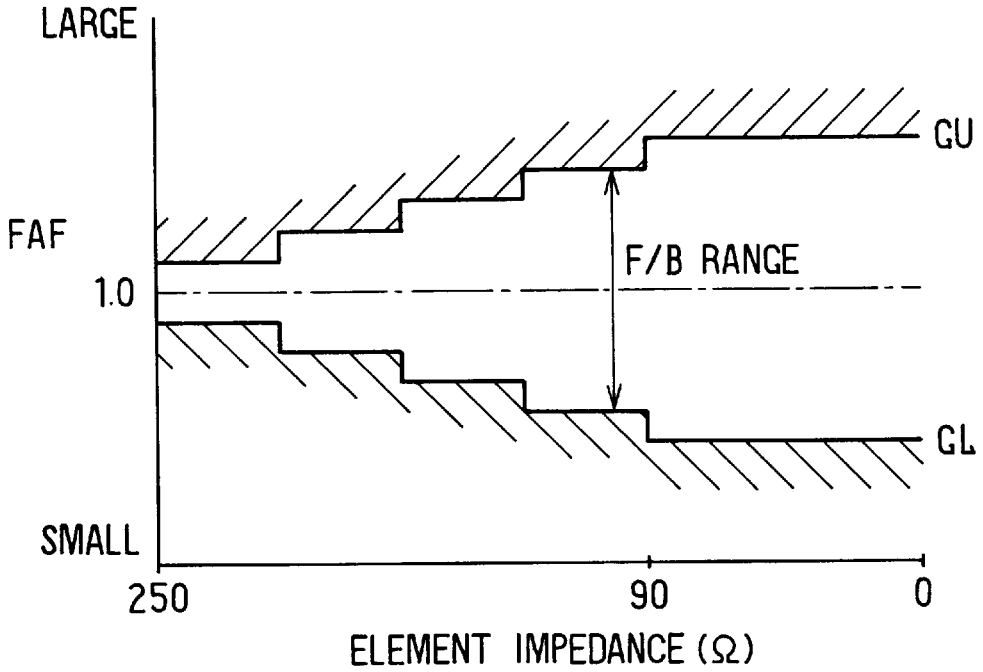
FIG. 10 is a diagram showing a map used for setting FAF guard values for the element impedance of the A/F sensor.

After the value of the FAF is calculated, the routine proceeds to step 220 of a continuation flowchart of the routine shown in FIG. 7 at which the CPU 51 sets FAF guard values corresponding to the element impedance Zdc. The FAF guard values are typically set as shown in FIG. 10. As shown in the figure, an upper guard value (GU) and a lower guard value (GL) are set respectively above and beneath a line representing for a reference value of 1.0 of the FAF, limiting a predetermined range. The range between the upper and lower guard values is a feedback range.

Then, the routine proceeds to step 221 at which the CPU 51 determines whether or not the value of the FAF calculated at step 219 as described above is greater than the upper guard value. If the calculated value of the FAF is found greater than the upper guard value (FAF>GU), the routine proceeds to step 222 at which the CPU 51 reduces the value of the FAF to the upper guard value (FAF=GU). Then, the routine proceeds to step 223 at which the CPU 51 computes the integration ZI for the upper guard value by using the following Eq. (5):

$$ZI=GU-(K1\times\lambda I+K2\times FAF1+---+Kn+1\times FAFn) \quad (5)$$

After the integration term is calculated, the CPU 51 returns to the routine shown in FIG. 5. It should be noted that the integration value ZI computed at step 223 will be reflected in the calculation of the FAF value in the next execution of the routine.

If the determination made at step 221 is NO, on the other hand, the routine proceeds to step 224 at which the CPU 51 determines whether or not the calculated value of the FAF described above is smaller than the lower guard value. If the calculated value of the FAF is found smaller than the lower guard value (FAF<GL), the routine proceeds to step 225 at which the CPU 51 increases the value of the FAF to the lower guard value (FAF=GL). Then, the routine proceeds to step 226 at which the CPU 51 computes the integration ZI for the upper guard value by using the following Eq. (6):

$$ZI=GL-(K1\times\lambda+K2\times FAF1+---+Kn+1\times FAFn) \quad (6)$$

After the integration is calculated, the CPU 51 returns to the routine shown in FIG. 5. It should be noted that the integration value ZI computed at step 226 will be reflected in the calculation of the FAF value in the next execution of the routine. If the determination made at steps 221 and 224 are both NO, the present routine is ended without correcting the value of the FAF and computing the integration FI.

It should be noted that, in the present embodiment, a sensor output determination is implemented by step 112 of the routine shown in FIG. 4 whereas a feedback control enabling or starting is implemented by step 113 of the routine shown in FIG. 4 and the routine shown in FIG. 5. In addition, the routine of the present embodiment shown in FIG. 5 also implements an air-fuel ratio control (fuel injection amount correction).

Figure 12:
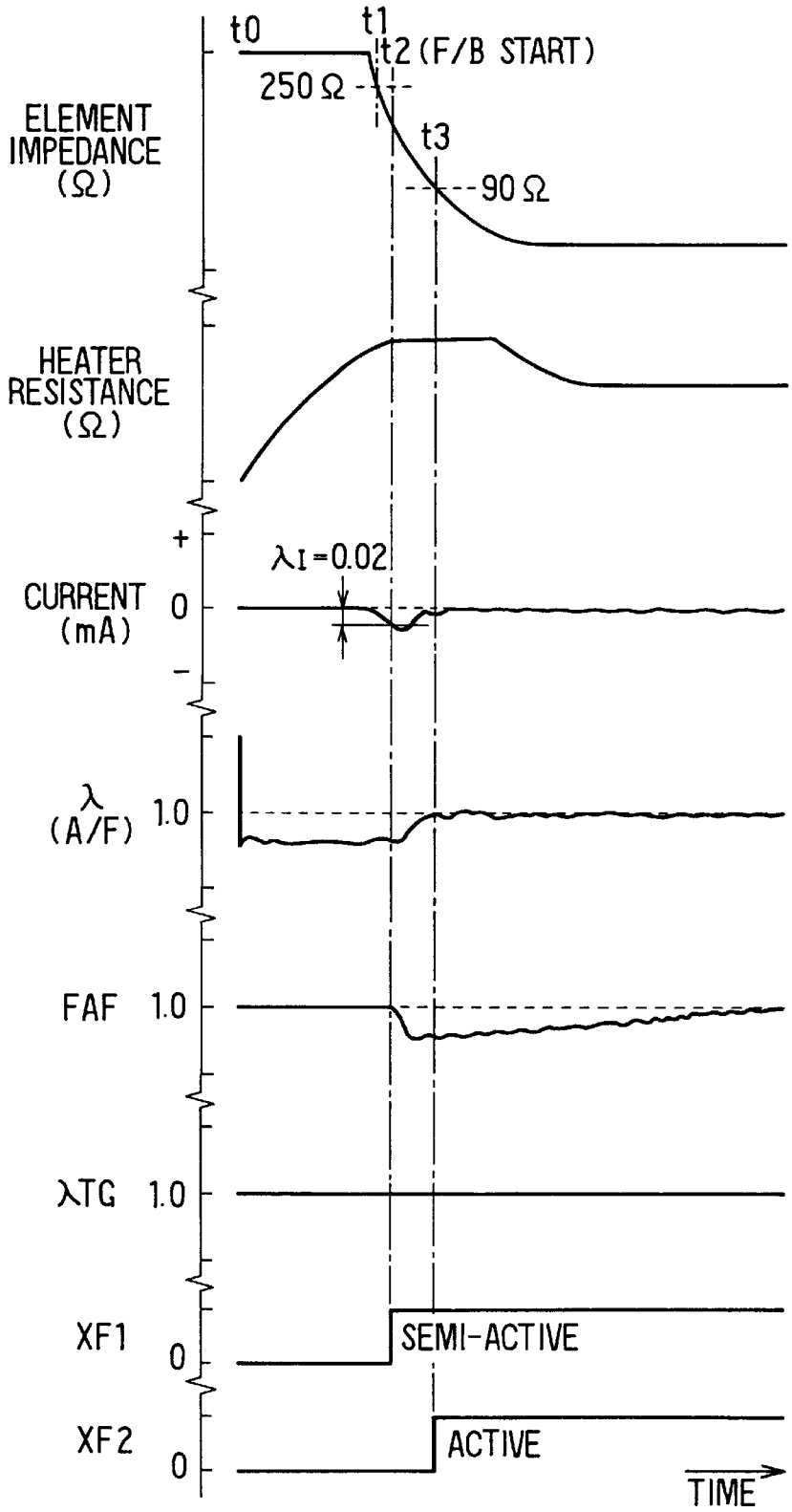
FIG. 12 is a time chart showing variations of various parameters for the feedback control of the air-fuel ratio during a period of transition from an inactive state of the A/F sensor to an active state thereof.

The present embodiment operates as shown by the time chart shown in FIG. 12 during a period of transition from an inactive state (a cold state) of the A/F sensor 26 to an active state thereof.

It is assumed that the engine 1 starts to run at time t0 at a low temperature. Since the A/F sensor 26 is still in an inactive state at the time t0, the element impedance is greater than 250 Ω. In addition, when the operation of the engine 1 is started, the injection amount of the fuel includes an additional portion used for heating the engine 1. That is, the fuel injection amount is increased and hence the air-fuel ratio is made small. Therefore, in spite of the fact that the actual air-fuel ratio λ is shifted to the rich side, the output current of the A/F sensor 26 has a value of 0 mA which usually corresponds to λ value of 1 under active state.

Then, at a time t1, the warming-up of the sensor device unit, that is, the A/F sensor 26, causes the element impedance thereof to decrease to 250 Ω. Accompanying the warming-up of the sensor device unit, the output current starts to flow gradually at a time around t1. At that time, the value of the target air-fuel ratio λTG is 1.0. Since the relation $0.98<\lambda TG<1.02$ is recognized at step 110 of the routine shown in FIG. 4, the determination made at step becomes YES.

Thereafter, at a time t2, the deviation $|\lambda TG-\lambda I|$ exceeds the predetermined criterion value 0.02, resulting in YES determination at step 112 of the routine shown in FIG. 4. Thus, the semi-active state flag XF1 is set at '1' at step 113 of the routine shown in FIG. 4. With the semi-active state flag XF1 is set at '1', the determination made at step 204 of the routine shown in FIG. 5 produces YES which allows the feedback control of the air-fuel ratio based on the advanced control theory to be started on the assumption that the conditions of the feedback control of the air-fuel ratio are satisfied. As the feedback control of the air-fuel ratio is started, the FAF is set at such a value that the air-fuel ratio λ is adjusted to match the target air-fuel ratio λTG.

Then, at a time t3, the element impedance further decreases to a value equal to or smaller than 90 Ω, producing YES determination at step 107 of the routine shown in FIG. 4. In this case, the active state flag XF2 is set at '1' at step 108 of the routine shown in FIG. 4. With the active state flag XF2 set at '1', the feedback control constants used in the feedback control of the air-fuel ratio are switched from "K1' to Kn'" to "K1 to Kn" by the routine shown in FIG. 6. Thereafter, the CPU 51 carries out the feedback control of the air-fuel ratio based on the feedback control constants K1 to Kn.

It may occur that the output current generated by the A/F sensor 26 varies due to the tolerance (change in input-output characteristics) of an electric circuit (e.g., driver circuit 60) employed in the ECU 40. The detected value of the output current varies due to the tolerances of circuits such as the current detecting circuit 68 employed in the sensor driver circuit 60. As a result, there are observed variations in output current due to solid state device variations of the ECU 40 even for the same A/F ratio. If there are such variations in A/F sensor output, the air-fuel ratio can not be controlled to a desired value. The inability to adjust the air-fuel ratio leads to deterioration of the exhaust emission. In order to solve this problem, in the present embodiment, the circuit tolerance is learned to eliminate such variations.

A tolerance or error learning routine is executed by the CPU 51 in order to learn the tolerance of the electric circuit. The routine is executed by the CPU 51 at predetermined intervals as triggered by a timer interrupt. In the present embodiment, the period of the intervals is set at 4 msec. In the circuit tolerance learning process, first of all, a learned circuit tolerance for absorbing tolerances of the circuit is calculated. Then, the value of a detected value of the output current of the A/F sensor 26 is corrected by using the learned tolerance each time the output current is output by the sensor 26.

Figure 13:
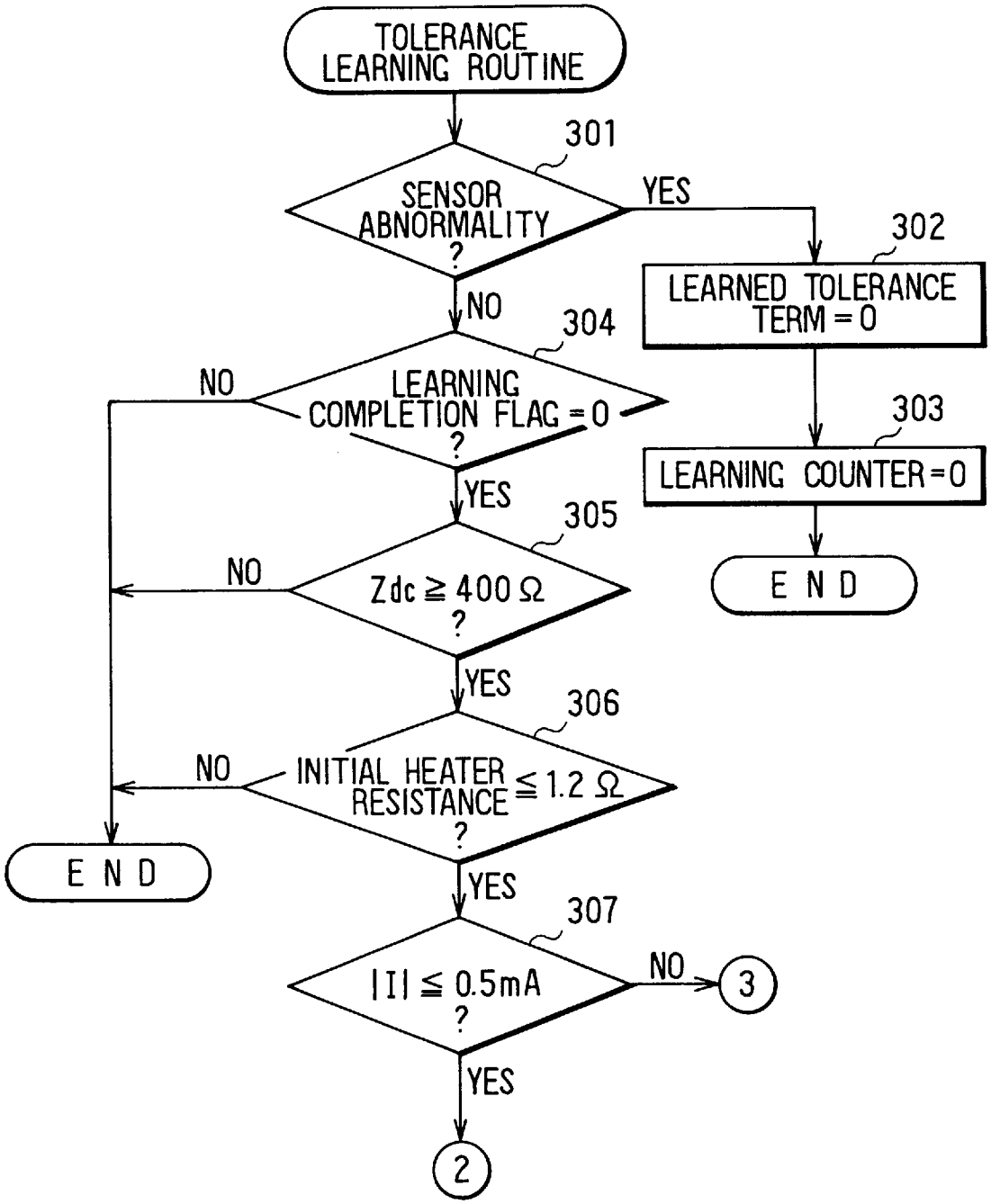
FIG. 13 is a flowchart showing a part of circuit tolerance learning routine for learning the tolerance of an output current circuit.

As shown in FIG. 13, the tolerance learning routine begins with step 301 at which the CPU 51 determines whether or not an abnormality has occurred in the sensor system. The determination is made by referring to the sensor abnormality flag XFAIL manipulated by the routine shown in FIG. 4 and an abnormality determination flag to be described later and by determining whether or not other abnormality information indicates the existence of an abnormality. In the event of an abnormality, the determination results in YES. In this case, the routine proceeds to step 302 at which the CPU 51 sets the learned tolerance at '0'. The routine then proceeds to step 303 at which the CPU 51 clears the contents of a learning counter to '0' before ending the present routine. That is, in the event of an abnormality occurring in the sensor system, the process of learning the circuit tolerance is not implemented.

In the event of no abnormality, on the other hand, the routine proceeds to step 304 at which the CPU 51 determines whether a learning completion flag is set at '0' or '1'. If the learning completion flag is set at '0', the routine proceeds to step 305. At step 305 and step 306, the CPU 51 determines whether or not the A/F sensor 26 is in a cold state and whether or not the sensor 26 is in an inactive state respectively. Specifically, at step 305, the CPU 51 determines whether or not the element impedance is equal to or greater than 400 Ω whereas, at step 306, the CPU 51 determines whether or not an initial heater resistance is equal to or smaller than 1.2 Ω. The initial heater resistance is a ratio of a heater voltage to a heater current which is computed at the time the engine 1 is started. That is, the initial heater resistance=heater voltage/heater current. If the determination made at either step 305 or step 306 is NO, the present routine ends.

If the determination made at steps 305 and 306 are both YES, on the other hand, the routine proceeds to step 307. At step 307, the CPU 51 determines whether or not the absolute value of the present output current I is equal to or smaller than a predetermined value which is set at 0.5 mA in the case of the present embodiment. In detail, the processing at step 307 is carried out to determine whether or not variations in output current of the A/F sensor 26 are within a predetermined tolerance, that is, a range between an allowable maximum value and an allowable minimum value of variations caused by a circuit tolerance and the like. An output current of the A/F sensor 26 in an inactive state outside the range −0.5 mA to +0.5 mA indicates an abnormality due to some causes. If $|I| \leqq 0.5$ mA, the CPU 51 continues the routine to step 308 shown in FIG. 14. If>0.5 mA, on the other hand, the CPU 51 continues the routine to step 314 shown in FIG. 14.

At step 308, the CPU 51 determines whether or not the absolute value of a difference $|Ii-Ii-1|$ between the immediately preceding output current Ii−1 and the present output current Ii is equal to or smaller than 0.02 mA, that is, whether or not the following relation holds true:

$$|Ii-Ii-1| \leqq 0.02\ mA$$

A NO outcome of the determination made at step 308 is interpreted by the CPU 51 as a small variation in output current. In this case, the routine proceeds to step 309 at which the CPU 51 clears the contents of learning counter to '0' before ending the present routine. If the determination made at step 308 is YES, on the other hand, the routine proceeds to step 310 at which the CPU 51 increments the contents of the learning counter by 1. Then, the routine proceeds to step 311. At step 311 the CPU 51 determines whether or not the contents of the learning counter are equal to or greater than a predetermined value which is set at 125 in the case of the present embodiment. If the determination made at step 311 is YES, the routine proceeds to step 312 at which the CPU 51 stores a smoothed value of the output current obtained at that time in the backup RAM unit 54 as a learned tolerance. Then, the routine proceeds to step 313 at which the CPU 51 sets the learning completion flag at '1' before ending the present routine.

Figure 14:
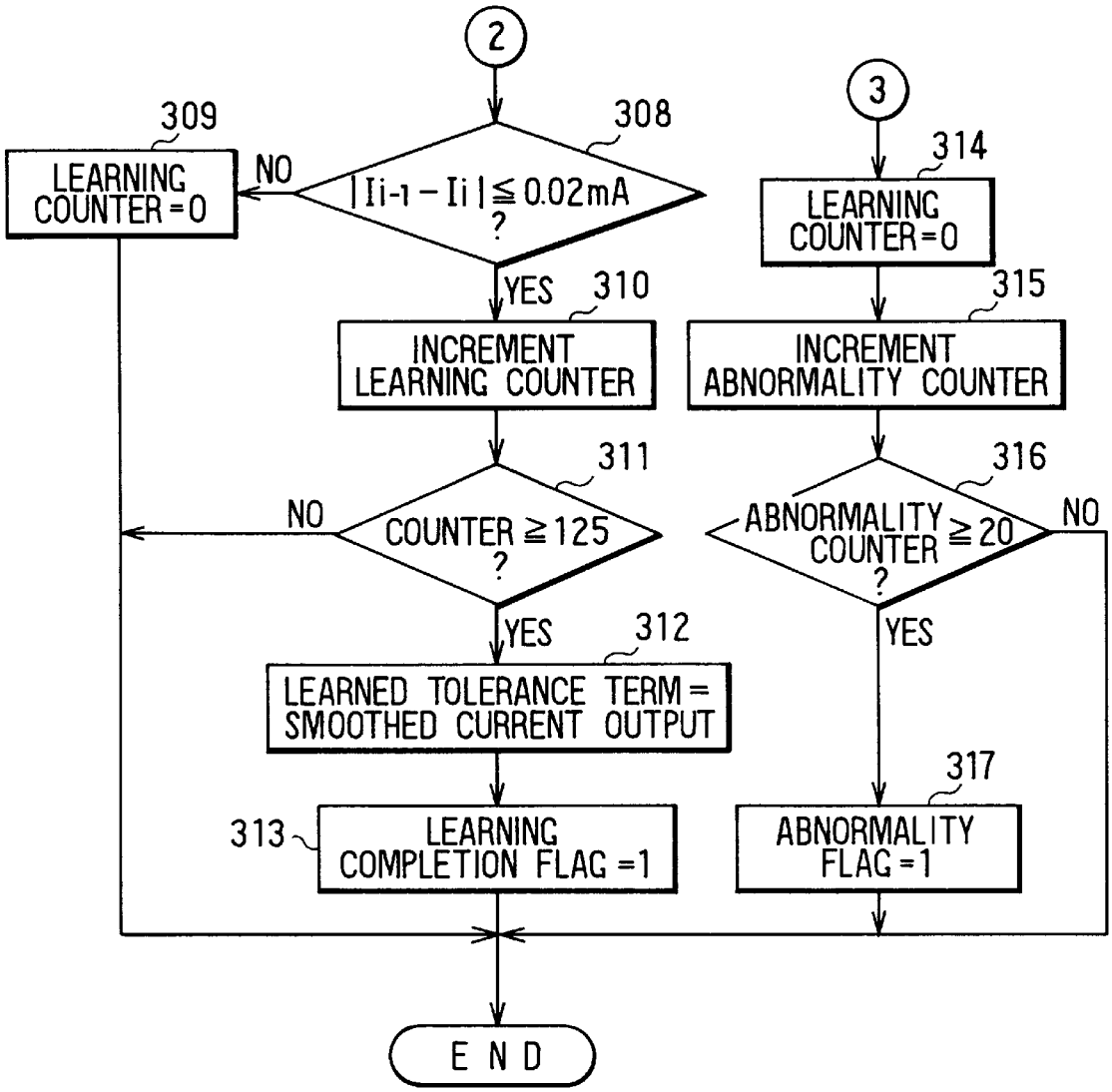
FIG. 14 is a flowchart showing another part of the routine for leaning the tolerance shown in FIG. 13.

On the other hand, the NO determination made at step 307 shown in FIG. 13 which leads the routine to step 314 shown in FIG. 14 is considered to indicate an abnormality caused by some reasons. Therefore, at step 314, the CPU 51 clears the contents of the learning counter to '0'. The routine then proceeds to step 315 at which the CPU 51 increments the contents of an abnormality counter by 1. Then, the routine proceeds to step 316. At step 316, CPU 51 determines whether or not the contents of the abnormality counter are equal to or greater than a predetermined value which is set at 20 in the case of the present embodiment. If the determination made at step 316 is YES, the routine proceeds to step 317 at which the CPU 51 sets the abnormality determination flag at '1' before ending the present routine.

Figure 15:
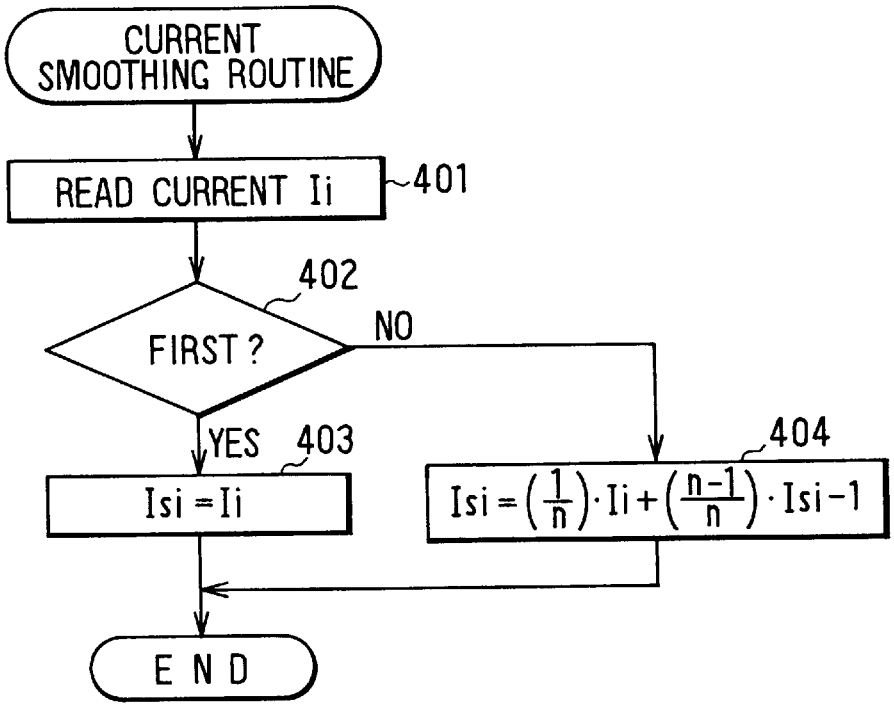
FIG. 15 is a flowchart showing an output current smoothing routine.

As shown in FIG. 15, a current smoothing routine begins with step 401 at which the CPU 51 reads the output current Ii of the A/F sensor 26. The routine then proceeds to step 402 at which the CPU 51 determines whether or not the operation to read the output current carried out at step 401 is a first reading operation. If the operation to read an output current carried out at step 401 is found to be a first reading operation, the routine proceeds to step 403 at which the CPU 51 adopts the output current read at step 401 as a smoothed value Is of the output current and stores the smoothed value in the RAM unit 53 temporarily.

If the operation to read the output current carried out at step 401 is found to be not a first read operation, on the other hand, the routine proceeds to step 404 at which the CPU 51 computes the smoothed value Is of the output current by using the following Eq. (7):

$$Isi=(1/n)\times Ii+\{(n-1)/n\}\times Isi-1 \quad (7)$$

The computed smoothed value of the output current is then stored in the RAM unit 53 temporarily.

Figure 16:
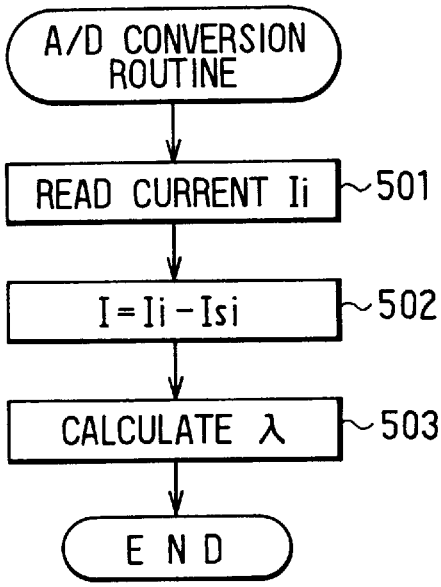
FIG. 16 is a flowchart showing an A/D conversion routine.

An A/D conversion routine which is executed by the CPU 51 at predetermined intervals as triggered by a timer interrupt is shown in FIG. 16. In the present embodiment, the period of the intervals is set at 4 msec. As shown in the figure, the learned tolerance computed by the routine shown in FIGS. 13 and 14 is utilized at step 502 of the A/D conversion routine, allowing a more accurate λ value (that is, the air-fuel ratio) to be found.

The A/D conversion routine represented by the flowchart shown in FIG. 16 begins with step 501 at which the CPU 51 reads an output current detected by the A/F sensor 26. The routine then proceeds to step 502 at which the CPU 51 subtracts the learned tolerance from the output current read at step 501 and uses the difference resulting from the subtraction as a new output current (Output current=Output current−Learned tolerance). Then, the routine proceeds to step 503 at which the CPU 51 obtains a λ value (that is, an air-fuel ratio) by referring to a conversion map shown in FIG. 11.

It should be noted that, in this embodiment, a sensor inactive state determination is implemented by steps 305 and 306 of the routine shown in FIG. 13 whereas a learning process inhibition is implemented by step 307 of the routine shown in FIG. 13 and step 308 of the routine shown in FIG. 14. A circuit tolerance learning is implemented by steps 308 to 312 of the routine shown in FIG. 14 whereas a sensor output correction is implemented by step 502 of the routine shown in FIG. 16.

Figure 17:
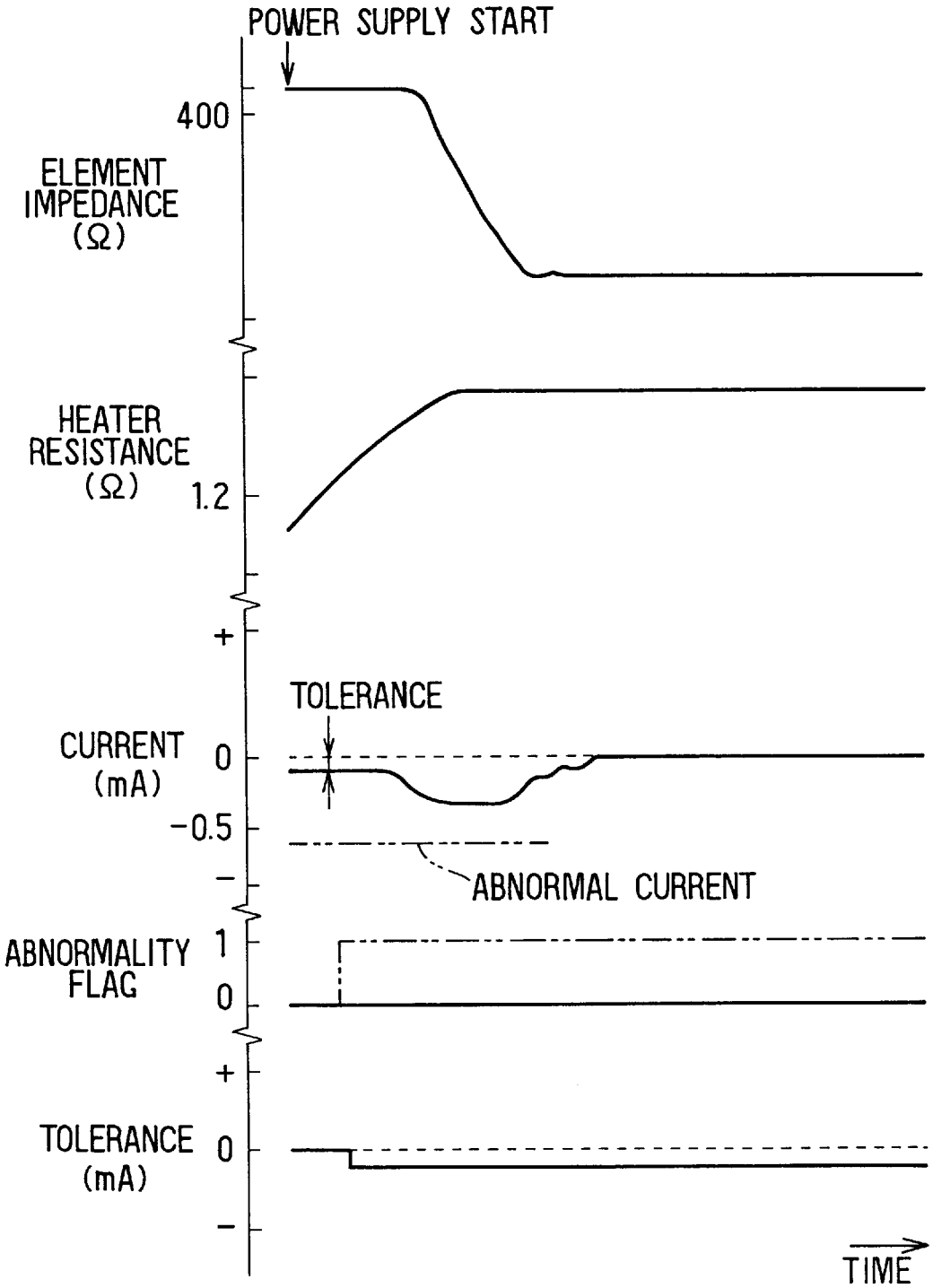
FIG. 17 is a time chart showing a circuit tolerance learning process.

FIG. 17 shows time charts for the circuit tolerance learning process. The figure shows behaviors starting from an inactive state (cold state) of the A/F sensor 26. At the time a power supply to the A/F sensor 26 is started, the element impedance has a value of 400 Ω or greater whereas the heater resistance has a value of 1.2 Ω or smaller. In such a state, the determination made at steps 305 and 306 of the routine shown in FIG. 13 are both YES.

In addition, at the time the power supply is started, a current value corresponding to a circuit tolerance is measured in spite of the fact that A/F sensor 26 is in an inactive state. At that time, since the difference between the immediately previous output current Ii−1 and the present output current Ii is small, a sensor output value obtained at that time is determined to be attributed to circuit variations (or sensor variations), giving rise to YES determination at step 308 of the routine shown in FIG. 14. If this state continues for a predetermined period of time, a learned tolerance is calculated at step 312 of the routine shown in FIG. 14. Since the output current by no means exceeds threshold values of ±0.5 mA used for determining an abnormality, that is, since the determination made at step 307 of the routine shown in FIG. 13 is YES, the abnormality determination flag is sustained at '0' as it is.

According to the embodiment described in detail above, the following advantages are provided.

(a) In the present embodiment, if the A/F sensor 26 is still in the state prior to activation and the actual air-fuel ratio is different from the air-fuel ratio represented by the output current of the sensor 26 in the state prior to activation, that is, if the air-fuel ratio is put on the rich side by an increased amount of fuel injected at a start of the engine 1 at a low temperature or other causes for example, at step 112 of the routine shown in FIG. 4, the CPU 51 determines whether or not the difference between the λ-conversion value of an output current of the sensor 26 and the target air-fuel ratio λTG is equal to or greater than a predetermined value. If the determination is YES, the feedback control of the air-fuel ratio is started. As a result, the feedback control of the air-fuel ratio can be started at an earlier time without the need to wait for the A/F sensor 26 to be activated completely. That is, when the engine 1 is started with the A/F sensor 26 still in a cold state (or an inactive state), the feedback control of the air-fuel ratio can be started earlier, thereby improving the drivability and the exhaust emission.

(b) The criterion value for determining whether or not the feedback control can be started is set at a minimum value of an allowable feedback control start zone for an accuracy parameter representing the processing power of the CPU 51 and the tolerance of the current detecting circuit 68 as shown in FIG. 9. In this way, it is possible to set the criterion value that is optimum for starting the feedback control early for each ECU.

(c) Besides the determination as to whether or not it is proper to start the feedback control of the air-fuel ratio as described in (a), the CPU 51 also determines based on the element impedance of the A/F sensor 26 as to whether or not it is proper to start the feedback control at steps 102 and 107 of the routine shown in FIG. 4. That is, the CPU 51 determines the activation state of the A/F sensor 26 from the element impedance. Since the activation state of the A/F sensor 26 can be determined directly, an accurate determination of the activation state can also be made also when it is desired to use the A/F sensor 26 from a semi-active state. Furthermore, also in a case where an output current of the A/F sensor 26 in an inactive state matches a current value representing the target air-fuel ratio, for example, in a case where the target air-fuel ratio is set at the stoichiometric air-fuel ratio and the output current of the A/F sensor 26 in an inactive state is 0 mA, it is possible to determine whether the sensor output is an output current generated in an active or inactive state.

(d) In addition, after the feedback control of the air-fuel ratio is started, feedback constants to be used in processing algorithms of the feedback control of the air-fuel ratio are set for the active state of the A/F sensor 26 at step 214 of the routine shown in FIG. 6 separately from feedback constants of the processing algorithms of the feedback control for the semi-active state of the A/F sensor 26 set at step 217 of the routine shown in FIG. 6. As a result, it is possible to use the output generated by the A/F sensor 26 while recognizing the fact the air-fuel ratio detection range is narrow and the fact that the responsiveness is poor in a semi-active state prior to an active state, allowing the feedback controllability of the air-fuel ratio to be improved.

(e) In the routines shown In FIGS. 13 to 16, in the inactive state of the A/F sensor 26, output currents are learned so that the tolerance of the current detecting circuit for detecting the output current generated by the A/F sensor 26 can be absorbed by correction of the output of the sensor 26 using results of the learning process. As a result, variations in detected sensor output caused by the circuit tolerance can be eliminated, allowing the control accuracy at the start of the feedback control of the air-fuel ratio to be improved. In addition, it is also possible to eliminate a problem that the feedback control is started late due to an effect of the circuit tolerance.

(f) In the process to learn the circuit tolerance, the learned tolerance produced in the process is stored and kept in the backup RAM 54. For this reason, the circuit tolerance learning process needs to be carried out only once even if there exists a circuit tolerance caused by solid state device variations. As a result, the processing load borne in the process to learn a circuit tolerance can be reduced.

(g) Furthermore, by adopting the following configurations in the present embodiment, an erroneous circuit tolerance learning process can be avoided.

The process to learn a circuit tolerance is carried out only when the element impedance of the A/F sensor 26 is equal to or greater than a predetermined value or the heater resistance is equal to or smaller than a predetermined value, that is, if the determination made at step 305 or 306 of the routine shown in FIG. 13 is YES.

The process to learn a circuit tolerance is inhibited when the output current generated by the A/F sensor 26 is at a predetermined current level exceeding a circuit tolerance, that is, if the determination made at step 307 shown in FIG. 13 is NO, or when variations in device circuit go beyond a predetermined range, that is, if the determination made at step 308 shown in FIG. 14 is NO.

The process to learn a circuit tolerance is inhibited when an abnormality is determined to have occurred in the A/F sensor 26 or the circuit system at steps 315 to 317 of the routine shown in FIG. 14 as evidenced by the fact that the state in which the output current generated by the A/F sensor 26 is held at a predetermined current level exceeding a circuit tolerance is sustained for a period of time longer than a predetermined length.

It should be noted, however, that the embodiment provided by the present invention can also be implemented in configurations described as follows.

As described above, at step 112 of the routine shown in FIG. 4, the CPU 51 determines based on a deviation in air-fuel ratio as to whether or not it is appropriate to start the feedback control of the air-fuel ratio. Instead of basing the determination of a deviation in air-fuel ratio, however, the embodiment can also be changed to a configuration in which the determination is based on a deviation in output current. more specifically, if the absolute value of a difference between the present output current generated by the A/F sensor 26 and a value of the output current representing the target air-fuel ratio is found greater than a predetermined criterion value at step 112 of the routine shown in FIG. 4, the feedback control of the air-fuel ratio is started.

In addition, in the case of a deviation in air-fuel ratio used as a base for determining whether or not it is appropriate to start the feedback control of the air-fuel ratio at step 112 of the routine shown in FIG. 4, that is, in the case of the absolute value of a difference between the λ-conversion value of an output current and the target air-fuel ratio λTG used as a base for making a determination, a minimum value of the allowable feedback control start zone shown in FIG. 9 is adopted as a criterion value in the determination. With the configuration of the new version in which the absolute value of a difference between the present output current generated by the A/F sensor 26 and a value of the output current representing the target air-fuel ratio is used as a base for determination, on the other hand, the way a criterion value is adopted in the determination can also be changed as well. For example, in place of a minimum value, any value within the allowable feedback control start zone shown in FIG. 9 can be adopted as a criterion value in the determination. If a value adopted as a criterion value in the determination is in an area on the left side of the characteristic curve Lb shown in FIG. 9, the feedback control of the air-fuel ratio can be started at a time earlier than the conventional air-fuel ratio control apparatus.

In the embodiment described above, the output current generated by the A/F sensor 26 in an inactive state coincides with an equivalent value of 0 A representing the stoichiometric air-fuel ratio which is used as a target air-fuel ratio. It should be noted, however, that the air-fuel ratio control apparatus can be implemented by a different configuration in which, for example, an output current of 0 A generated in an inactive state of the A/F sensor 26 represents an air-fuel ratio on the lean side.

In the embodiment described above, the FAF value is set in accordance with a procedure represented by the flowchart shown in FIGS. 6 and 7. It is worth noting, however, that the way of setting the FAF value can also be changed. For example, an FAF value can be set without distinguishing the active and inactive states from each other. That is, feedback constants of the feedback control of the air-fuel ratio common to the active and inactive states can be set. In addition, the processing to limit the FAF value by the upper and lower guard values can also be eliminated in order to make the load of the entire processing lighter.

The pieces of processing carried out at steps 307 and 314 to 317 of the circuit tolerance learning routine provided by the present embodiment shown in FIGS. 13 and 14 can also be eliminated in order to make the routine simpler. In addition, a sequence of operations related to the circuit tolerance learning process, that is, the pieces of processing of the routines shown in FIGS. 13 to 16 can be eliminated from the implementation.

Furthermore, in the embodiment described above, a control method based on the advanced control theory is embraced for implementing feedback control of the air-fuel ratio. It should be noted, however, that the control method can also be changed as well. For example, PI control or PID control can be selected in an implementation to form a combination with the control method based on the advanced control theory.

The present invention should not be limited to the above disclosed embodiment and its modifications but may be changed further without departing from the spirit of the invention.

We claim:

1. An air-fuel ratio control apparatus for an internal combustion engine comprising:

an air-fuel ratio sensor for outputting a current representing an air-fuel ratio of mixture to an internal combustion engine in response to a voltage applied to the air-fuel ratio sensor;

air-fuel ratio control means for carrying out a feedback control of the air-fuel ratio based on a deviation of the current of the air-fuel ratio sensor from a current representing a target air-fuel ratio;

sensor output determination means for determining whether the current of the air-fuel ratio sensor has changed from a value in an initial state by a difference greater than a predetermined value when the air-fuel ratio sensor is in a state prior to activation and has a value different from a value represented by the current of the air-fuel ratio sensor in the state prior to the activation; and feedback control starting means for starting the feedback control of the air-fuel ratio when the determination means determines that the current of the air-fuel ratio sensor has changed from the value in the initial state by the difference greater than the predetermined value.

2. The air-fuel ratio control apparatus of claim 1, wherein:

the sensor output determination means determines whether the current of the air-fuel ratio sensor in the state prior to the activation has changed from the current value representing the target air-fuel ratio by a deviation greater than a predetermined criterion value if the current of the air-fuel ratio sensor in the state prior to the activation agrees with the current representing the target air-fuel ratio.

3. The air-fuel ratio control apparatus of claim 2, wherein:

the predetermined criterion value of the sensor output determination means is set at a minimum value of an allowable feedback control start zone defined by a processing power of a controller for implementing the feedback control of the air-fuel ratio and a tolerance of a current detecting circuit (68) for detecting the current of the air-fuel ratio sensor.

4. The air-fuel ratio control apparatus of claim 1, further comprising:

element impedance detecting means for detecting an element impedance of the air-fuel ratio sensor, and implementing the feedback control of the air-fuel ratio if the element impedance detected by the element impedance detecting means is smaller than a predetermined active state criterion value.

5. The air-fuel ratio control apparatus of claim 1, further comprising:

sensor state identifying means for identifying an active state and an inactive state of the air-fuel ratio sensor; and control constant setting means for setting different control constants of the air-fuel ratio control means according to active state and the inactive state of the air-fuel ratio sensor after the feedback control of the air-fuel ratio has been started by the feedback control starting means.

6. The air-fuel ratio control apparatus of claim 1, further comprising:

sensor inactive state determination means for determining whether the air-fuel ratio sensor is in an inactive state;

circuit tolerance learning means for learning a value of the current of the air-fuel ratio sensor in the inactive state of the air-fuel ratio sensor so as to absorb a circuit tolerance of a current detecting circuit for detecting the current output of the air-fuel ratio sensor; and sensor output correcting means for correcting the current of the air-fuel ratio sensor by an amount equal to the circuit tolerance learned by the circuit tolerance learning means.

7. The air-fuel ratio control apparatus of claim 6, wherein:

the circuit tolerance learned by the circuit tolerance learning means is stored and kept in a backup memory at a time the circuit tolerance is learned by the circuit tolerance learning means.

8. The air-fuel ratio control apparatus of claim 6, wherein:

the sensor inactive state determination means determines the air-fuel ratio sensor to be in the inactive state, if the element impedance of the air-fuel ratio sensor is greater than a predetermined value or if a resistance of a heater provided in the air-fuel ratio sensor is smaller than a predetermined value.

9. The air-fuel ratio control apparatus of claim 6, further comprising:

learning inhibiting means for inhibiting the circuit tolerance learning means from learning the circuit tolerance of the current detecting circuit according to the current of the air-fuel ratio sensor.

10. The air-fuel ratio control apparatus of claim 9, wherein:

the learning inhibiting means inhibits the circuit tolerance learning means from learning the circuit tolerance of the current detecting circuit if variations in the current of the air-fuel ratio sensor is beyond a predetermined range.

11. The air-fuel ratio control apparatus of claim 9, wherein:

the learning inhibiting means inhibits the circuit tolerance learning means from learning the circuit tolerance of the current detecting circuit if the current of the air-fuel ratio sensor is at a current level exceeding the circuit tolerance.

12. The air-fuel ratio control apparatus of claim 6, further comprising:

abnormality determination means for determining the state of the air-fuel ratio sensor or a circuit system to be abnormal if the current of the air-fuel ratio sensor is at a current level exceeding the circuit tolerance continuously for at least a predetermined period of time.

13. A method of controlling an air-fuel ratio of air-fuel mixture comprising the steps of:

detecting an air-fuel ratio by an air-fuel ratio sensor which produces a current varying with the air-fuel ratio of mixture;

determining whether the air-fuel ratio sensor is in a semi-active state in accordance with a change in the current of the air-fuel ratio sensor, the semi-active state occurring between an inactive state and an active state; and enabling a feedback control of the air-fuel ratio of mixture by the current of the air-fuel ratio sensor in response to a determination of the semi-active state.

14. The method of claim 13, wherein:

the determining step compares the current of the air-fuel ratio sensor with a reference corresponding to a target air-fuel ratio to determine the semi-active state.

15. The method of claim 13, further comprising the steps of:

determining whether the air-fuel ratio sensor has changed from the semi-active state to the active state; and changing a feedback control constant from a smaller value to a larger value when the air-fuel ratio sensor is determined to have changed from the semi-active state to the active state.

16. The method of claim 13, further comprising the steps of:

detecting an impedance of the air-fuel ratio sensor; and limiting a range of the feedback control to a narrower range as the detected impedance increases.

17. The method of claim 13, further comprising the steps of:

determining whether a learning of a tolerance is possible with the air-fuel ratio sensor being in the inactive state;

learning the tolerance in response to a determination of the determining step indicating that the learning is possible; and correcting the current of the air-fuel ratio sensor by the learned tolerance during a feedback control of the air-fuel ratio.

18. A method of controlling an air-fuel ratio of mixture comprising the steps of:

detecting an air-fuel ratio by an air-fuel ratio sensor which produces a current varying with the air-fuel ratio;

determining whether a tolerance learning is possible with the sensor being in an inactive state;

learning the tolerance when the determining step indicates that the learning is possible;

correcting the current of the air-fuel ratio sensor by the learned tolerance; and controlling the air-fuel ratio of mixture by the corrected current.

19. The method of claim 18, wherein:

the determining step determines a tolerance learning condition by an element impedance of the air-fuel ratio sensor and a change in the current of the air-fuel ratio sensor.

20. The method of claim 18, further comprising:

determining whether the sensor is in a semi-active state in accordance with a change in the current of the air-fuel ratio sensor, the semi-active state occurring between an inactive state and an active state; and enabling a feedback control of the air-fuel ratio by the current of the sensor in response to a determination of the semi-active state.

* * * * *